US011633956B2

(12) United States Patent
Azami et al.

(10) Patent No.: US 11,633,956 B2
(45) Date of Patent: Apr. 25, 2023

(54) LIQUID DISCHARGE HEAD, LIQUID DISCHARGE DEVICE, LIQUID DISCHARGE APPARATUS, AND INTERMEDIATE MEMBER

(71) Applicant: Ricoh Company, Ltd., Tokyo (JP)

(72) Inventors: Hiroshi Azami, Kanagawa (JP); Takashi Kinokuni, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/362,105

(22) Filed: Jun. 29, 2021

(65) Prior Publication Data

US 2022/0024215 A1 Jan. 27, 2022

(30) Foreign Application Priority Data

Jul. 22, 2020 (JP) ..... JP2020-125465

(51) Int. Cl.
*B41J 2/175* (2006.01)
*B41J 2/14* (2006.01)

(52) U.S. Cl.
CPC ..... *B41J 2/17563* (2013.01); *B41J 2/14* (2013.01); *B41J 2/17523* (2013.01); *B41J 2/14274* (2013.01); *B41J 2/175* (2013.01); *B41J 2002/14362* (2013.01)

(58) Field of Classification Search
CPC ..... B41J 2/17563; B41J 2/14; B41J 2/17523; B41J 2/14274; B41J 2/175; B41J 2002/14362
See application file for complete search history.

(56) References Cited

U.S. PATENT DOCUMENTS

| | | | | |
|---|---|---|---|---|
| 9,073,334 | B2 * | 7/2015 | Hagiwara | B41J 2/155 |
| 2013/0155159 | A1 | 6/2013 | Kinokuni et al. | |
| 2013/0182040 | A1 | 7/2013 | Kinokuni et al. | |
| 2013/0182044 | A1 | 7/2013 | Kinokuni | |
| 2014/0028756 | A1 | 1/2014 | Nishimura et al. | |
| 2014/0063138 | A1 | 3/2014 | Takahagi et al. | |
| 2019/0283416 | A1 | 9/2019 | Kinokuni | |
| 2020/0171829 | A1 | 6/2020 | Kinokuni | |
| 2020/0247665 | A1 | 8/2020 | Azami et al. | |
| 2021/0001652 | A1 | 1/2021 | Kinokuni et al. | |

FOREIGN PATENT DOCUMENTS

| | | |
|---|---|---|
| JP | 2006-218670 | 8/2006 |
| JP | 2014-024230 | 2/2014 |
| JP | 2019-038125 | 3/2019 |

* cited by examiner

*Primary Examiner* — Geoffrey S Mruk
(74) *Attorney, Agent, or Firm* — Xsensus LLP

(57) ABSTRACT

A liquid discharge head includes a liquid port, a frame including a liquid channel in which a liquid supplied from the liquid port flows, and an intermediate member between the liquid port and the frame. The liquid port includes a first connection portion connectable to the frame, the frame includes a second connection portion connectable to the first connection portion of the liquid port, and the intermediate member includes a third connection portion connectable to the second connection portion of the frame and a fourth connection portion connectable to the first connection portion of the liquid port.

11 Claims, 17 Drawing Sheets

LIQUID DISCHARGE HEAD, LIQUID DISCHARGE DEVICE, LIQUID DISCHARGE APPARATUS, AND INTERMEDIATE MEMBER

CROSS-REFERENCE TO RELATED APPLICATION

This patent application is based on and claims priority pursuant to 35 U.S.C. § 119(a) to Japanese Patent Application No. 2020-125465, filed on Jul. 22, 2020, in the Japan Patent Office, the entire disclosures of which is hereby incorporated by reference herein.

BACKGROUND

Technical Field

Aspects of the present disclosure relate to a liquid discharge head, a liquid discharge device, a liquid discharge apparatus, and an intermediate member.

Related Art

There is an image forming apparatus of liquid discharge recording type. The image forming apparatus uses a recording head including a liquid discharge head (inkjet head) that discharge a liquid. Examples of the image forming apparatus includes a printer, a facsimile, a copy device, a plotter, a multifunction peripheral, for example. The inkjet recording apparatus includes a liquid discharge head as a recording head to discharge a liquid. As such an image forming apparatus, for example, an inkjet recording apparatus is known.

In an inkjet head, there is a technique in which a filter or a member having a filter function is attached to a channel part or an interior of channel with adhesive or the like to form a part of the channel part. However, the filter in the inkjet head is fixed by adhesive or the like. Thus, it is necessary to cut, destroy, or the like a part of the channel to replace the filter.

Further, there is a technique of a detachable filter. However, the detachable filter that is configured to be detachably attachable to the channel part has problems in which it is necessary to discharge the liquid inside the filter or to remove air bubbles inside the filter after the filter is attached to the channel part. Thus, it takes time to attach or replace the filter to the channel part.

SUMMARY

In an aspect of this disclosure, a liquid discharge head includes a liquid port, a frame including a liquid channel in which a liquid supplied from the liquid port flows, and an intermediate member between the liquid port and the frame. The liquid port includes a first connection portion connectable to the frame, the frame includes a second connection portion connectable to the first connection portion of the liquid port, and the intermediate member includes a third connection portion connectable to the second connection portion of the frame and a fourth connection portion connectable to the first connection portion of the liquid port.

In another aspect of this disclosure, an intermediate member configured to be disposed between two members is disclosed. The intermediate member includes a connection portion on one surface of the intermediate member, and another connection portion on another surface of the intermediate member, wherein the connection portion has a shape different from a shape of said another connection portion and connectable to said another connection portion.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1A:
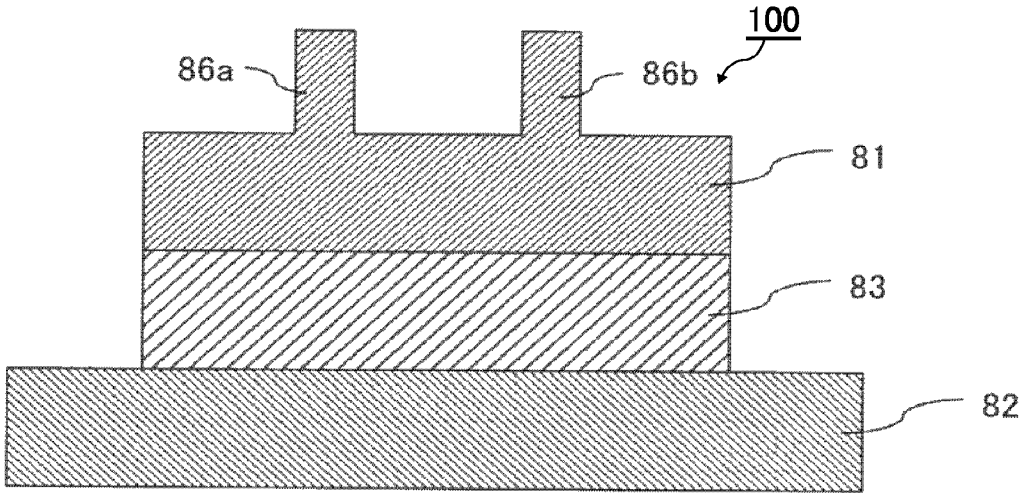
FIG. 1A is a schematic cross-sectional view of a liquid discharge head in an Embodiment 1 and FIG. 1B is a schematic cross-sectional view of the liquid discharge head in which a connection state of each member in the liquid discharge head in the Embodiment 1 is released (separated)

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, a liquid discharge head, a liquid discharge device, a liquid discharge apparatus, and an intermediate member according to an embodiment of the present disclosure is described with reference to the drawings. Note that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

A liquid discharge head according to the present embodiment includes a liquid port, a frame including a liquid channel in which a liquid supplied from the liquid port flows, and an intermediate member between the liquid port and the frame. The liquid port includes a first connection portion connectable to the frame, the frame includes a second connection portion connectable to the first connection portion of the liquid port, and the intermediate member includes a third connection portion connectable to the second connection portion of the frame and a fourth connection portion connectable to the first connection portion of the liquid port.

Embodiment 1

An example of a liquid discharge head 100 and an intermediate member according to an Embodiment 1 of the present disclosure is described below.

FIG. 1A a is a schematic cross-sectional side view of a main part of a liquid discharge head 100 according the Embodiment 1. Hereinafter, the "liquid discharge head 100" is simply referred to as a "head 100". In the example illustrated in FIG. 1, an ink port 81, a filter 83, and a frame 82 are connected with each other.

Figure 1B:
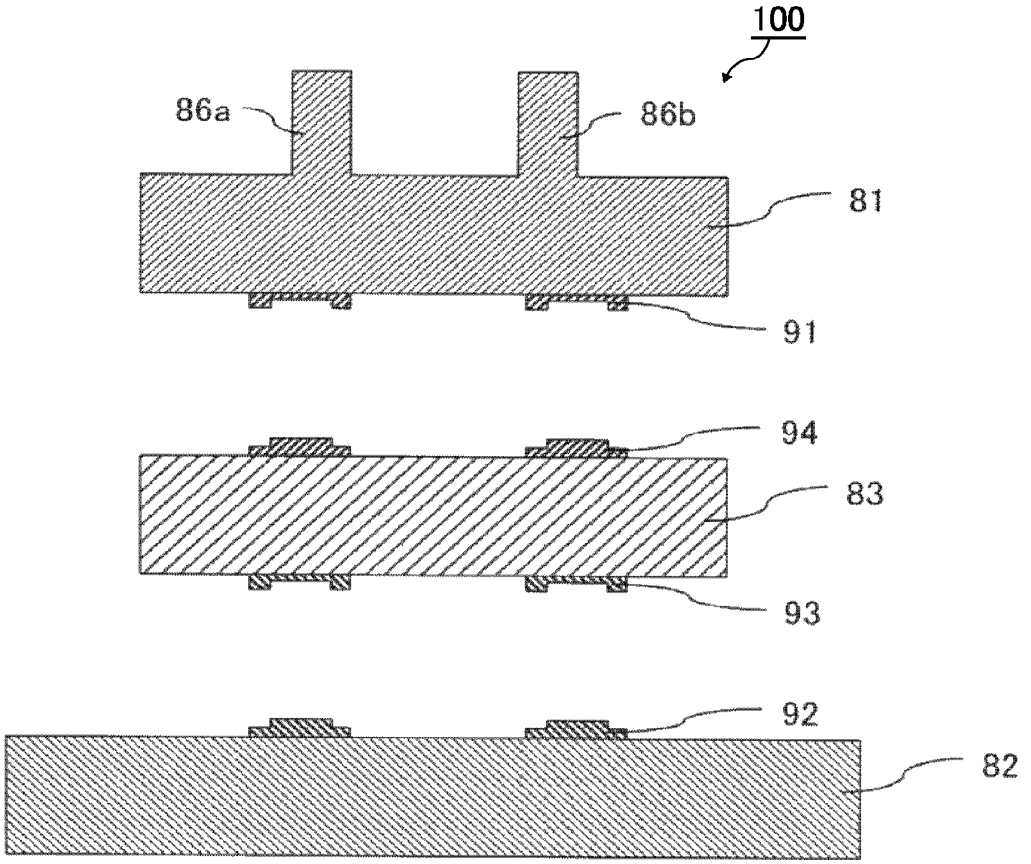

FIG. 1B is a schematic cross-sectional side view of the head 100 in which a connection state of each member in the head 100 of the present embodiment is released (separated) to describe a connection method of each member.

The ink port 81 is an example of a liquid port (liquid supply device). The ink port 81 supplies liquid such as ink to the frame 82. The ink port 81 includes ink supply ports 86*a* and 86*b*, and the liquid is supplied to the ink port 81 from ink supply ports 86*a* and 86*b* to the ink port 81, for example. Hereinafter, the "ink supply ports 86*a* and 86*b*" are collectively referred to as the "ink supply port 86". The "ink supply port" is also referred to as a "liquid supply port" since any types of liquid including ink can be discharged from the head 100.

The filter 83 (filter member) is an example of an intermediate member, and has a function of filtering a supplied liquid, for example. As illustrated in FIG. 1B, the filter 83 is provided between the ink port 81 and the frame 82. Thus, the intermediate member (filter 83) is disposed between two members such as the ink port 81 and the frame 82.

The frame 82 is an example of a frame, and a liquid channel is formed in the frame 82. The liquid is supplied from the ink port 81 to the liquid channel in the frame 82. The liquid supplied from the ink port 81 flows through the liquid channel of the frame 82 and is then supplied to, for example, a channel forming member described below.

The ink port 81 includes a first connection portion 91 connectable to the frame 82. The frame 82 includes a second connection portion 92 connectable to the ink port 81. In the head 100 according to the Embodiment 1, the first connection portion 91 is not connected to the second connection portion 92. However, the first connection portion 91 is connectable to the second connection portion 92 in the Embodiment 1.

The filter 83 includes a third connection portion 93 and a fourth connection portion 94. The third connection portion 93 of the filter 83 has a shape identical to a shape of the first connection portion 91 of the ink port 81.

The fourth connection portion 94 of the filter 83 has a shape identical to a shape of the second connection portion 92 of the frame 82. The filter 83 is detachably attachable between the ink port 81 and the frame 82. When the filter 83 is attached to the ink port 81 and the frame 82, the first connection portion 91 and the fourth connection portion 94 are connected, and the second connection portion 92 and the third connection portion 93 are connected.

In a state in which members of the ink port 81, the filter 83, and the frame 82 is connected with each other, ink flows through the connection portions of the members. In the head 100 in the Embodiment 1, ink flows through a portion in which the first connection portion 91 of the ink port 81 and the fourth connection portion 94 of the filter 83 are connected to each other. In the head 100 in the Embodiment 1, ink flows through a portion in which the third connection portion 93 of the filter 83 and the second connection portion 92 of the frame 82 are connected to each other.

As described above, the ink port 81 is connectable to the filter 83, the filter 83 is connectable to the frame 82, and the ink port 81 is directly connectable to the frame 82. Thus, the filter 83 can be arbitrarily attached and detached from the ink port 81 and the frame 82. Therefore, the head 100 is easily detachably attached an unnecessary member or a necessary member in the liquid channel. Further, the liquid channel can be easily maintained even when the member is attached or detached.

Shapes of the first connection portion 91 to the fourth connection portion 94 can be appropriately selected. For example, each of the first connection portion 91 and the third connection portion 93 may have an opening shape. Further, the second connection portion 92 and the fourth connection portion 94 may have a tubular shape, for example. Thus, the second connection portion 92 and the fourth connection portion 94 having the tubular shape can be respectively inserted into and connected with the third connection portion 93 and the first connection portion 91 having the opening shape. Thus, the second connection portion 92 and the fourth connection portion 94 are fittable and connectable to the third connection portion 93 and the first connection portion 91.

Thus, the third connection portion 93 has a shape different from a shape of the fourth connection portion 94 and connectable to the fourth connection portion 94.

Note that shapes of the first connection portion 91 to the fourth connection portion 94 illustrated in FIG. 1B are schematically illustrated for description.

In the head 100 according to the Embodiment 1, the filter 83 is detachable from the ink port 81 and the frame 82. For example, when the filter 83 is clogged and a supply of ink is disturbed, the filter 83 can be replaced with another filter 83, for example, a new filter 83. Accordingly, it is not necessary to replace the entire head in order to replace the filter, and it is possible to easily solve problems such as clogging. Further, the filter 83 is detachably attachable to the ink port 81 and the frame 82 without cutting or destroying other members. Thus, the head 100 is easily replace and attach the filter 83.

Although the filter 83 has been described as an example of the intermediate member in the Embodiment 1, the present embodiment is not limited to the filter 83. Other members such as a damper may be used as the intermediate member. Note that the intermediate member to be used includes the third connection portion 93 and the fourth connection portion 94.

FIG. 1B illustrates the head 100 in the Embodiment 1 that includes two of the first connection portion 91, two of the second connection portion 92, two of the third connection portion 93, two of the fourth connection portion 94, and two ink supply ports 86 as an example. However, the present embodiment is not limited to a configuration as described above.

A number of each of the first connection portion 91 to the fourth connection portion 94 and the ink supply port 86 may be one or more than two. When the head 100 includes two or more of each of the first connection portion 91 to the fourth connection portion 94 and the ink supply port 86, it is preferable that the number of the first connection portion 91 to the fourth connection portion 94 and the number of the ink supply port 86 are made identical.

When the number of the first connection portion 91 to the fourth connection portion 94 and the ink supply port 86 are not identical, that is, when there is a redundant connection portion having no corresponding connection destination, it may be necessary to take measures such as blocking redundant liquid channels of the first connection portion 91 to the fourth connection portion 94 and the ink supply port 86.

Further, the head 100 according to the present embodiment may be configured as a circulation type head when each of the ink port 81, the frame 82, and the filter 83 includes two or more of the first connection portion 91, the second connection portion 92, the third connection portion 93, and the fourth connection portion 94.

In this case, for example, one liquid channel may be a forward path (supply channel) and one liquid channel may a backward path (collection channel).

Thus, the head 100 includes a nozzle 4 configured to discharge the liquid, a supply channel upstream from the nozzle 4 in a liquid supply direction, and a collection channel downstream from the nozzle 4 in the liquid supply direction. The liquid is circulated from the supply channel to the collection channel through the nozzle 4 in the liquid supply direction.

The first connection portion 91 includes a first supply connection portion and a first collection connection portion. For example, a left side of the first connection portion 91 in FIG. 1B is the first supply connection portion, and a right side of the first connection portion 91 in FIG. 1B is the first collection connection portion.

The second connection portion 92 includes a second supply connection portion and a second collection connection portion. For example, a left side of the second connection portion 92 in FIG. 1B is the second supply connection portion, and a right side of the second connection portion 92 in FIG. 1B is the second collection connection portion.

The third connection portion 93 includes a third supply connection portion and a third collection connection portion. For example, a left side of the third connection portion 93 in FIG. 1B is the third supply connection portion, and a right side of the third connection portion 93 in FIG. 1B is the third collection connection portion.

The fourth connection portion 94 includes a fourth supply connection portion and a fourth collection connection portion. For example, a left side of the fourth connection portion 94 in FIG. 1B is the fourth supply connection portion, and a right side of the fourth connection portion 94 in FIG. 1B is the fourth collection connection portion.

The supply channel includes the first supply connection portion, the second supply connection portion, the third supply connection portion, and the fourth supply connection portion, and the collection channel includes the first collection connection portion, the second collection connection portion, the third collection connection portion, and the fourth collection connection portion.

Thus, the head 100 according to the Embodiment 1 configures a circulation-type head that circulates the liquid (ink) from the supply channel to the collection channel and again to the supply channel without wasting the liquid (ink).

Figure 2:
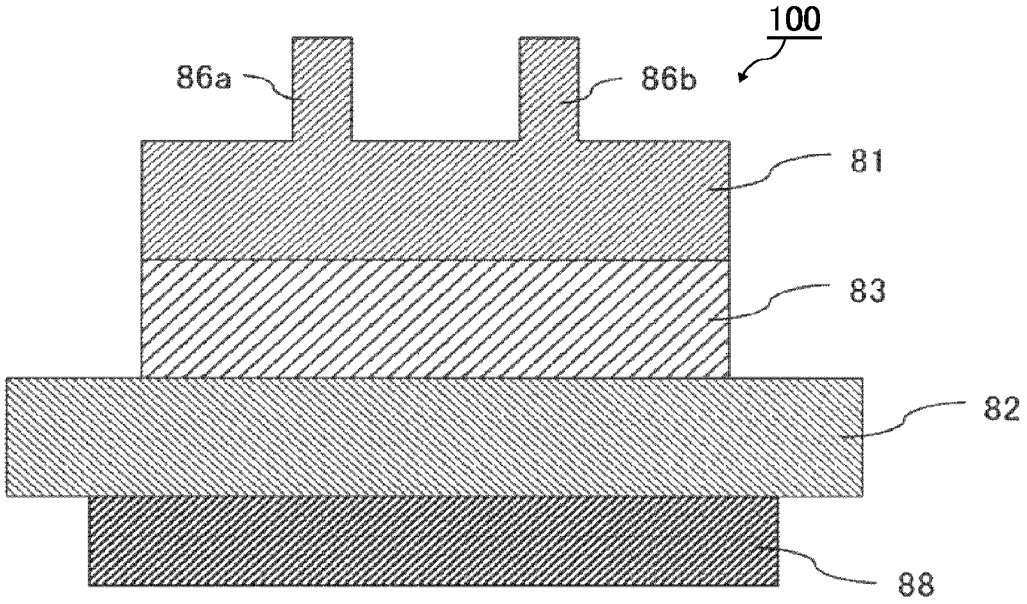
FIG. 2 is another schematic cross-sectional view of the liquid discharge head according to the Embodiment 1.

FIG. 2 is a schematic cross-sectional side view of another example of the head 100 according to the Embodiment 1.

FIG. 2 illustrates an example in which the head 100 includes a channel forming member 88 joined to the frame 82. The channel forming member 88 includes, for example, a nozzle plate 1, a channel plate 2, a diaphragm 3, a piezoelectric actuator 11, a common channel member 20, and the like of the head 100 as illustrated in FIG. 10.

Figure 10:
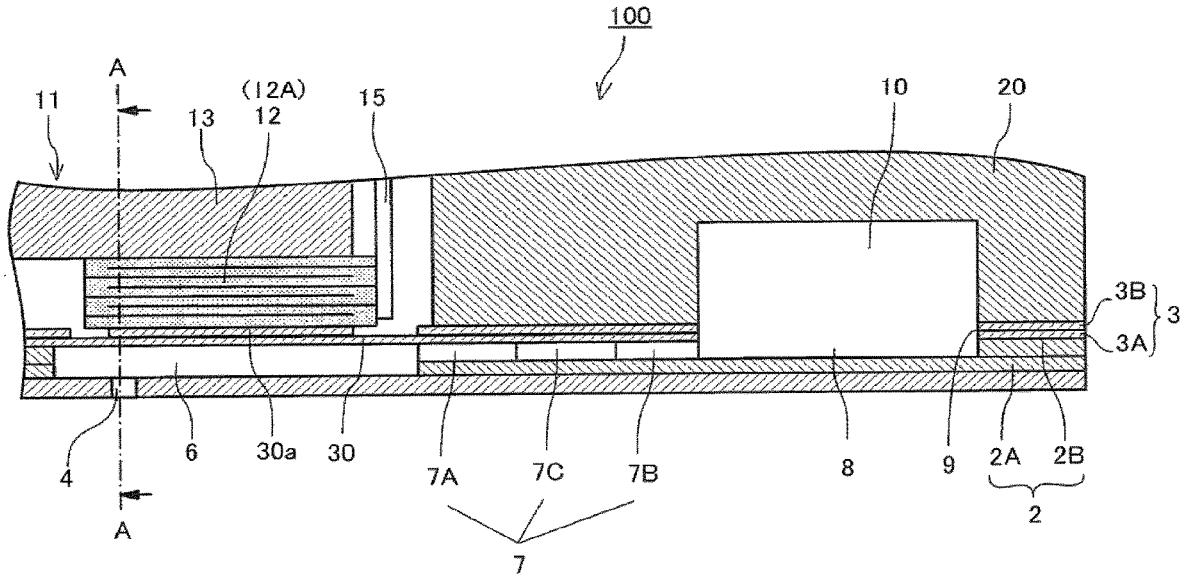
FIG. 10 is a schematic cross-sectional view of a liquid discharge head according to still another embodiment of the present disclosure.

The channel forming member 88 may further include, for example, a common supply channel 10, a pressure chamber 6 (individual chamber), a piezoelectric element 12, a nozzle 4, and the like of the head 100 as illustrated in FIG. 10.

Thus, the channel forming member 88 can be configured as illustrated in FIG. 10 and the like as described below, for example. However, a configuration of the channel forming member 88 is not limited to a configuration of the head 100 as illustrated in FIG. 10. When the channel forming member 88 is connected to the frame 82, the frame 82 supplies the liquid to the channel forming member 88.

Embodiment 2

Another example of the head 100 and the intermediate member according to an Embodiment 2 of the present disclosure is described below. Redundant descriptions of the same matters as those described above may be omitted below.

Figure 3A:
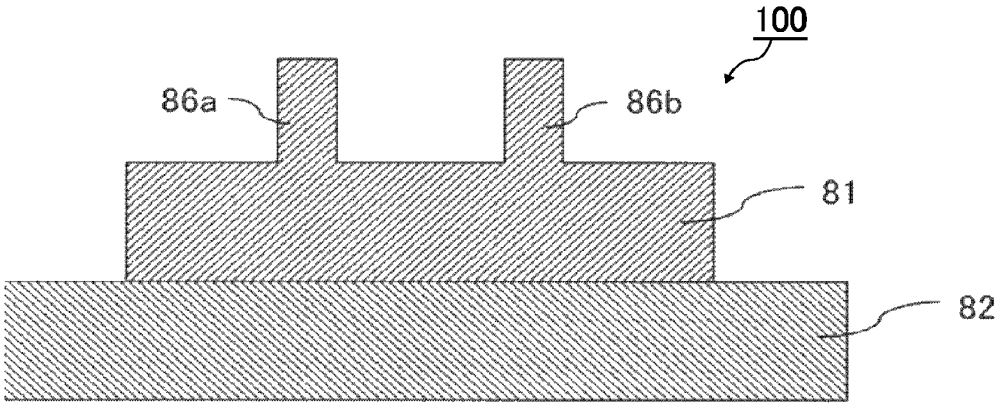
FIG. 3A is a schematic cross-sectional view of the liquid discharge head in an Embodiment 2 and FIG. 3B is a schematic cross-sectional view of the liquid discharge head in which a connection state of each member in the liquid discharge head in the Embodiment 2 is released (separated)

FIG. 3A a is a schematic cross-sectional side view of a main part of the head 100 according an Embodiment 2.

Figure 3B:
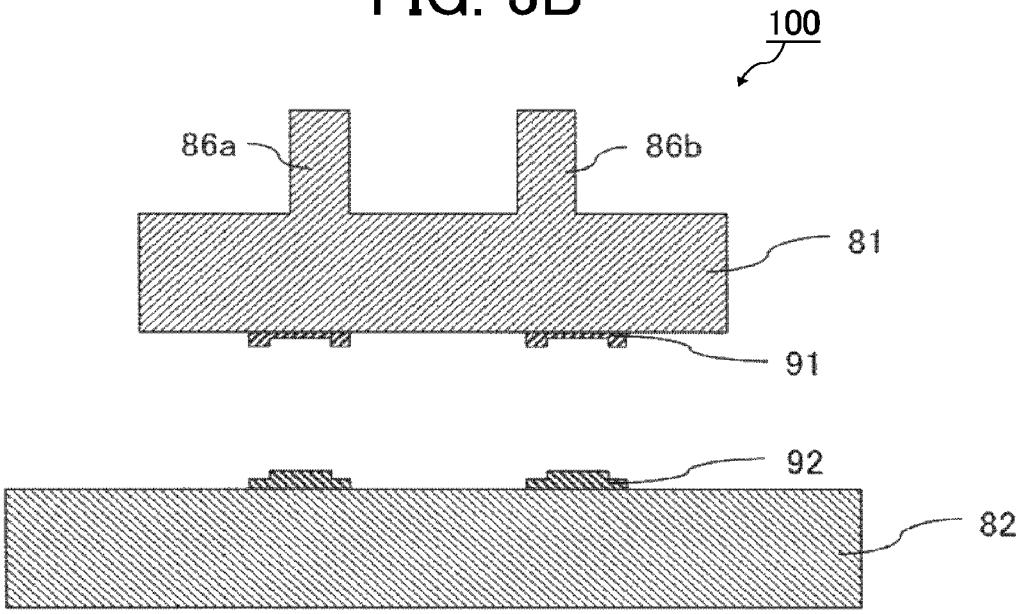

FIG. 3B is a schematic cross-sectional side view of the head 100 in which a connection state of each member in the head 100 of the Embodiment 2 is released (separated).

As illustrated in FIGS. 3A and 3B, the ink port 81 is directly connected to the frame 82.

As illustrated in FIG. 3B, the first connection portion 91 of the ink port 81 is connectable to the second connection portion 92 of the frame 82. Thus, the ink port 81 and the frame 82 are connectable to each other without interposing an intermediate member such as the filter 83 in FIGS. 1A and 1B, and FIG. 2. In the above manner, even when the ink port 81 and the frame 82 are directly connected to each other without interposing the intermediate member, a liquid channel is formed between the ink port 81 and the frame 82. Thus, the head 100 can easily maintain the liquid channel even when the intermediate member is attached or detached.

Thus, the head 100 according to the Embodiment 2 does not include the intermediate member such as the filter 83, and the ink port 81 and the frame 82 is directly connectable with each other. Therefore, when the head 100 does not need the filter 83, the filter 83 is detached from the head 100 without destruction of the members of the head 100 to establish the liquid channel. Thus, the head 100 can solve a problem such as a discharge failure caused by the filter 83 although the filter 83 is unnecessary. Further, the head 100 can form the liquid channel without the intermediate member (with removal of the intermediate member from the head 100) and thus can reduce an apparatus size (size of the head 100).

A case in which the filter 83 is not necessary in the head 100 includes a case in which the filter 83 is disposed on an upstream of the ink port 81. However, the case in which the filter 83 is not necessary in the head 100 is not limited to the case as described above.

Embodiment 3

Next, still another example of the head 100 and the intermediate member according to an Embodiment 3 is described with reference to FIGS. 4A and 4B. Redundant descriptions of the same matters as those described above may be omitted below.

Figure 4A:
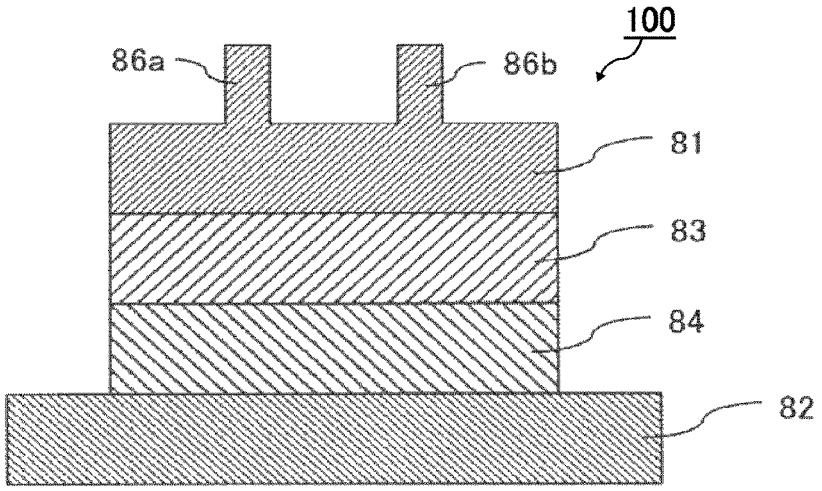
FIG. 4A is a schematic cross-sectional view of the liquid discharge head in an Embodiment 3 and FIG. 4B is a schematic cross-sectional view of the liquid discharge head in which a connection state of each member in the liquid discharge head in the Embodiment 3 is released (separated)

FIG. 4A is a schematic cross-sectional side view of a main part of the head 100 according the Embodiment 3.

Figure 4B:
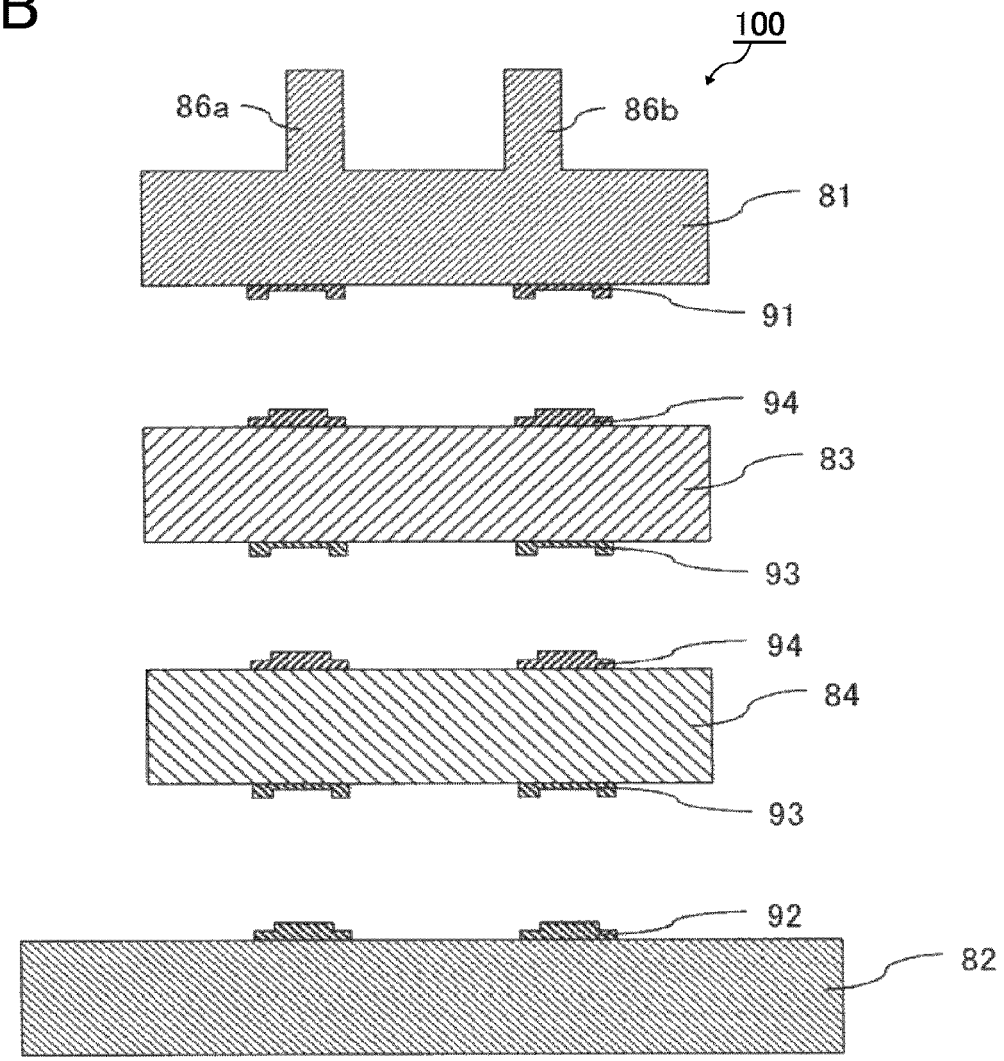

FIG. 4B is a schematic cross-sectional side view of the head 100 in which a connection state of each member in the head 100 of the Embodiment 3 is released (separated).

As illustrated in FIGS. 4A and 4B, the filter 83 and a damper 84 are connected as an intermediate member between the ink port 81 and the frame 82.

In the Embodiment 3, multiple intermediate members (the filter 83 and the damper 84) can be attached between the ink port 81 and the frame 82. When the multiple intermediate members (the filter 83 and the damper 84) are attached to the head 100, each of the multiple intermediate members (the filter 83 and the damper 84) includes the third connection portion 93 and the fourth connection portion 94. Thus, the intermediate members (the filter 83 and the damper 84) can be connected to each other.

As described above, necessary members can be arbitrarily added to the liquid channel according to the Embodiment 3. Further, the head 100 does not have to change other members in the liquid channel, and the head 100 can easily add necessary members. Further, the added member can be easily removed from the head 100.

The damper 84 is provided to reduce a pressure fluctuation due to ink discharge by the head 100. The damper 84 may be appropriately selected, and for example, a member having a flexible film inside the member may be used as the damper 84.

Embodiment 4

Still another example of the head 100 and the intermediate member according to an Embodiment 4 of the present disclosure is described below. Redundant descriptions of the same matters as those described above may be omitted below. The Embodiment 4 is an example in which a filter 83 is used as the intermediate member as in the Embodiment 1, and an example of the connection portion is described in more detail.

Figure 5A:
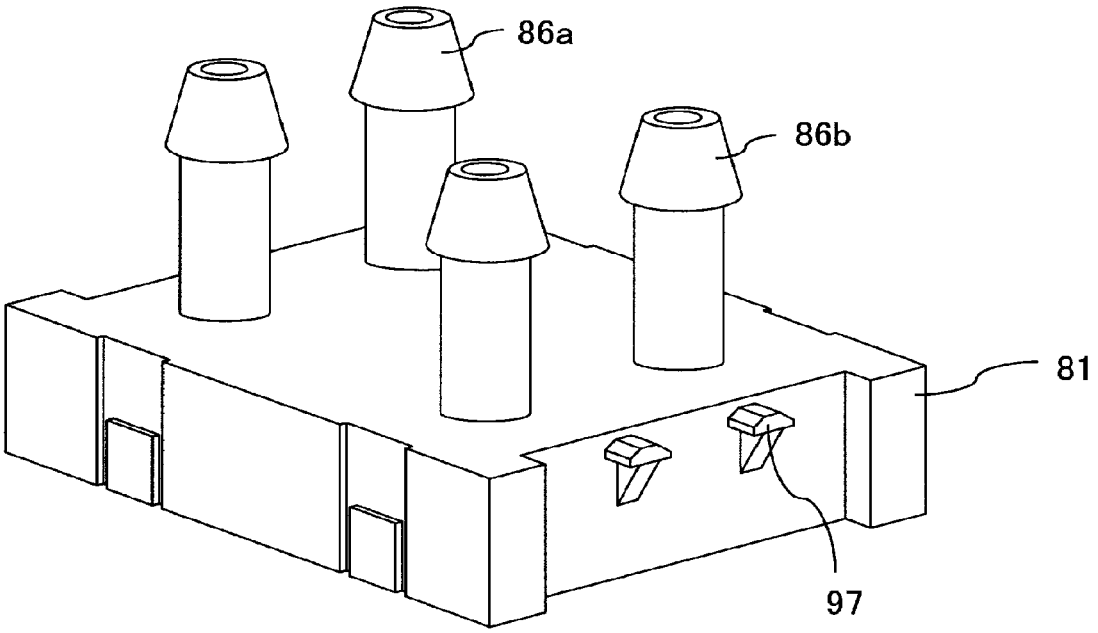
FIG. 5A is a top perspective view of an ink port and FIG. 5B is a bottom view of the ink port of the liquid discharge head in an Embodiment 4.

FIG. 5A is a top perspective view of the ink port 81 of the head 100 in the Embodiment 4 viewed from the top of the ink port 81.

Figure 5B:
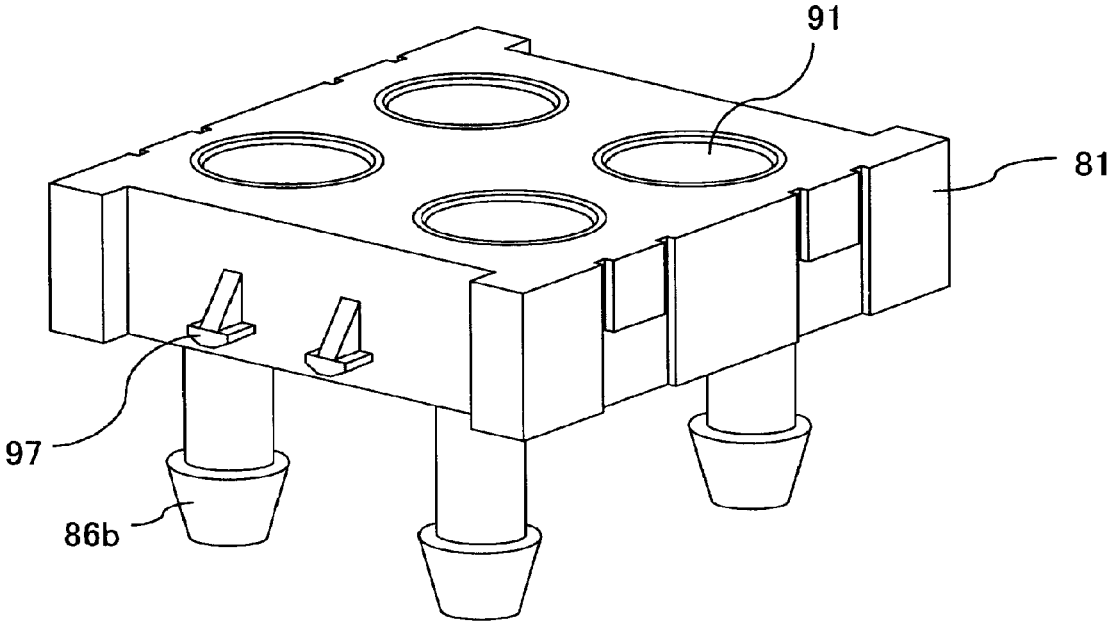

FIG. 5B is a bottom perspective view of the ink port 81 of the head 100 in the Embodiment 4 viewed from the bottom of the ink port 81.

As illustrated in FIG. 5A, the ink port 81 includes the ink supply ports 86*a* and 86*b* on an upper surface of the ink port 81.

As illustrated in FIG. 5B, the first connection portion 91 has an opening. A number of the ink supply ports 86 and a number of the first connection portions 91 are not limited to the number of the ink supply ports 86 and the number of the first connection portions 91 as illustrated in FIGS. 5A and 5B.

Although the first connection portion 91 has a circular opening, a shape of the opening is not limited to a circular and may have other shapes.

As illustrated in FIG. 5A, the ink port 81 in the Embodiment 4 includes a protruding part 97 on a side surface of the ink port 81. Accordingly, the members can be more firmly fixed to each other by hooking a claw 98 (see FIG. 6A) described below to the protruding part 97. A number, an arrangement, and the like of the protruding part 97 are not limited to the number and the arrangement of the protruding part 97 as illustrated in FIGS. 5A and 5B.

In the Embodiment 4, the protruding part 97 is an example of a first latching member, and the claw 98 is an example of a second latching member. Latching the claw 98 on the protruding part 97, that is, latching the second latching member on the first latching member can more firmly fix the members with each other.

Figure 6A:
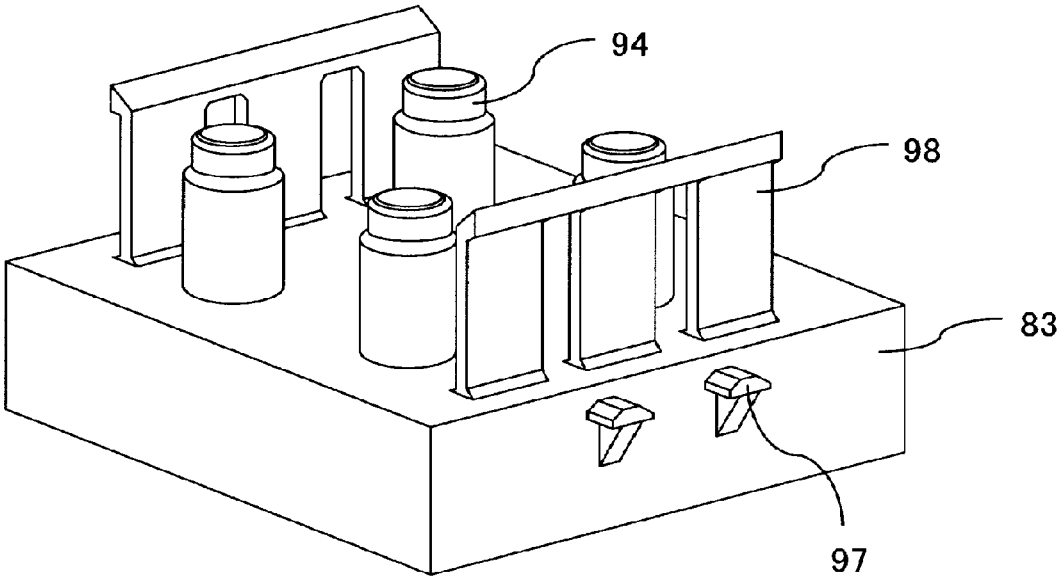
FIG. 6A is a top perspective view of a filter and FIG. 6B is a bottom view of the filter of the liquid discharge head in the Embodiment 4.

FIG. 6A is a top perspective view of the filter 83 according to the Embodiment 4 viewed from the top of the filter 83.

Figure 6B:
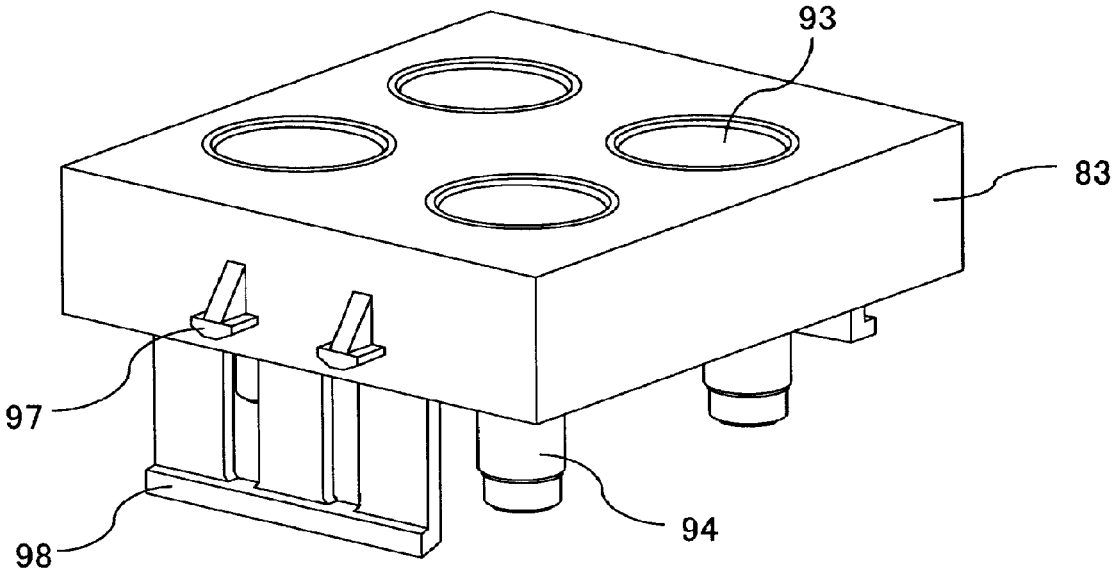

FIG. 6B is a bottom perspective view of the filter 83 according to the Embodiment 4 viewed from the bottom of the filter 83.

As illustrated in FIG. 6A, the fourth connection portion 94 is provided on an upper surface of the filter 83. In the Embodiment 4, the fourth connection portion 94 has a cylindrical shape, and is inserted into and connected to the opening of the first connection portion 91 having an opening shape. As described above, the first connection portion 91 is formed to engage with (connectable to) the fourth connection portion 94 (see FIG. 1B and FIG. 4B).

In the Embodiment 4, the shape of the connection portion is not limited to the above and can be appropriately selected. Alternatively, the first connection portion 91 may have a tubular shape, and the fourth connection portion 94 may have an opening shape, for example.

As illustrated in FIG. 6B, the third connection portion 93 has an opening shape having an opening similarly to the first connection portion 91.

As illustrated in FIG. 6B, the filter 83 in the Embodiment 4 includes the claw 98 on an upper surface of the filter 83. Accordingly, the claw 98 of the filter 83 catches the protruding part 97 in the ink port 81, and thus the members can be more firmly fixed to each other. An arrangement, a shape, and the like of the claw 98 are not limited to the arrangement, the shape, and the like of the claw 98 illustrated in FIGS. 6A and 6B. The arrangement, the shape, and the like of the claw 98 can be appropriately modified.

Figure 7A:
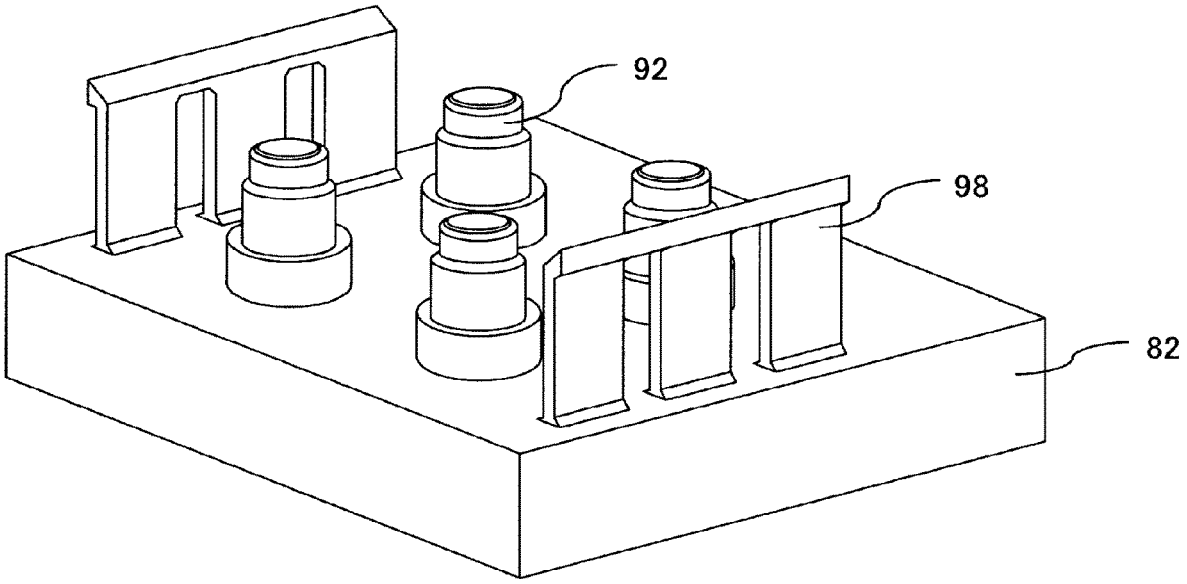
FIG. 7A is a top perspective view of a frame and FIG. 7B is a bottom view of the frame of the liquid discharge head in the Embodiment 4.

FIG. 7A is a top perspective view of the frame 82 according to the Embodiment 4 viewed from the top of the frame 82.

Figure 7B:
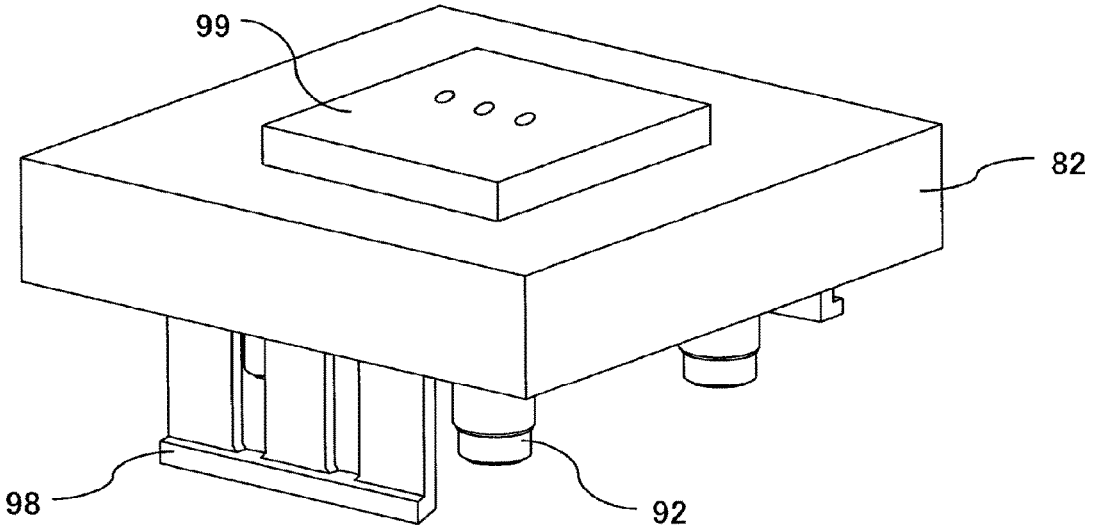

FIG. 7B is a bottom perspective view of the frame 82 according to the Embodiment 4 viewed from the bottom of the frame 82.

As illustrated in FIG. 7A, the frame 82 includes the second connection portion 92 on an upper surface of the frame 82. In the Embodiment 4, the second connection portion 92 has a cylindrical shape similar to the shape of the fourth connection portion 94 and is inserted into and connected to the opening of the third connection portion 93 having the opening shape.

The first connection portion 91 is formed to engage with (connectable to) the fourth connection portion 94, and since the second connection portion 92 and the fourth connection portion 94 have the same shape (see FIGS. 1B and 4B), the first connection portion 91 and the second connection portion 92 are formed to engage with (connectable with) each other.

Therefore, the first connection portion 91 and the second connection portion 92 can be connected to each other, and the ink port 81 and the frame 82 can be connected to each other without interposing the filter 83 as the intermediate member as illustrated in FIGS. 3A and 3B.

As illustrated in FIG. 7A, the frame 82 in the Embodiment 4 includes the claw 98 on the upper surface of the frame 82. Thus, the claw 98 of the frame 82 is latched on the protruding part 97 provided on the filter 83 so that the members of the frame 82 and the filter 83 can be more firmly fixed.

In the Embodiment 4, the shape of the first connection portion 91 is the same as the shape of the third connection portion 93, and the shape of the second connection portion 92 is the same as the shape of the fourth connection portion 94.

However, the shape of the first connection portion 91 may not necessary be strictly identical to the shape of the third connection portion 93, and the shape of the second connection portion 92 may not necessary be strictly identical to the shape of the fourth connection portion 94.

The first connection portion 91 may be formed to be connectable to the second connection portion 92 and the fourth connection portion 94, and the second connection portion 92 may be formed to be connectable to the first connection portion 91 and the third connection portion 93.

For example, an opening diameter of the opening of the first connection portion 91 is not necessarily strictly identical to an opening diameter of the opening of the third connection portion 93 in the Embodiment 4. Further, a diameter of the second connection portion 92 having the tubular shape is not necessarily strictly identical to a diameter of the fourth connection portion 94 having the tubular shape in the Embodiment 4.

Further, the frame 82 includes a channel forming member connector 99 on a lower surface of the frame 82 in the embodiment 4 as illustrated in FIG. 7B. The channel forming member connector 99 is connected to the channel forming member 88. Thus, the liquid can be supplied to the channel forming member 88 via the channel forming member connector 99.

Figure 8:
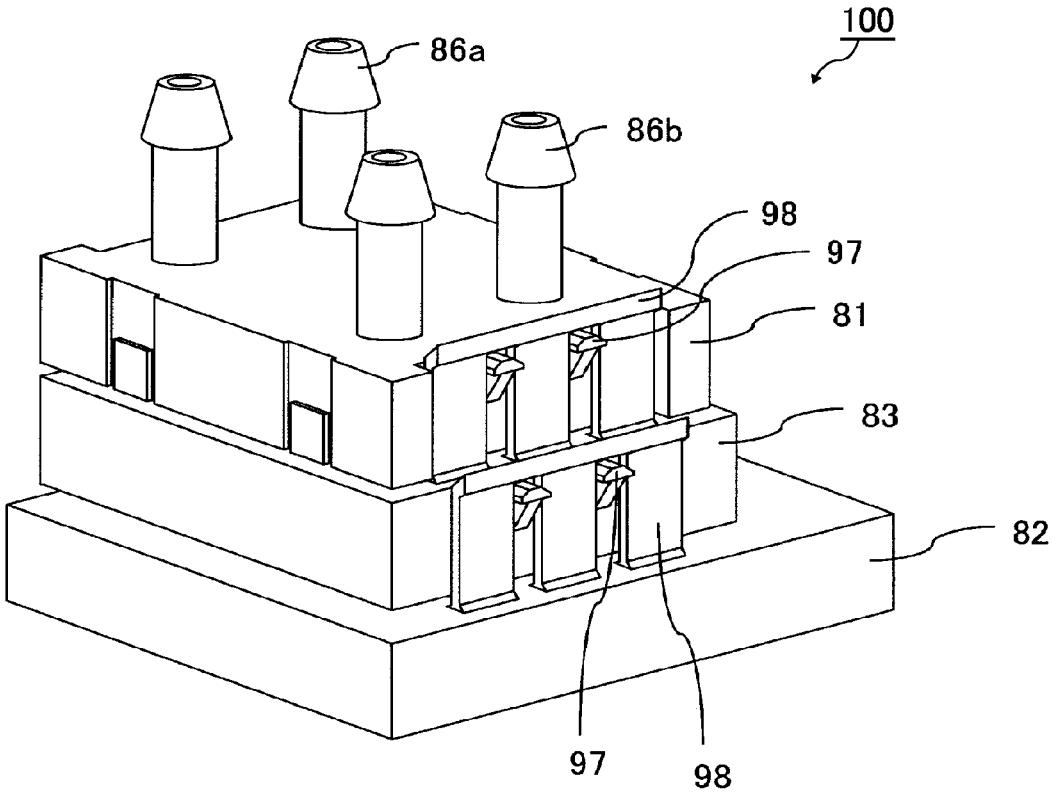
FIG. 8 is a perspective view of an example of the liquid discharge head according to the Embodiment 4.

FIG. 8 is a perspective view of the head 100 according to the Embodiment 4. FIG. 8 illustrates an example of the head 100 in which each member of the ink port 81, the frame 82, and the filter 83 is connected.

Figure 9A:
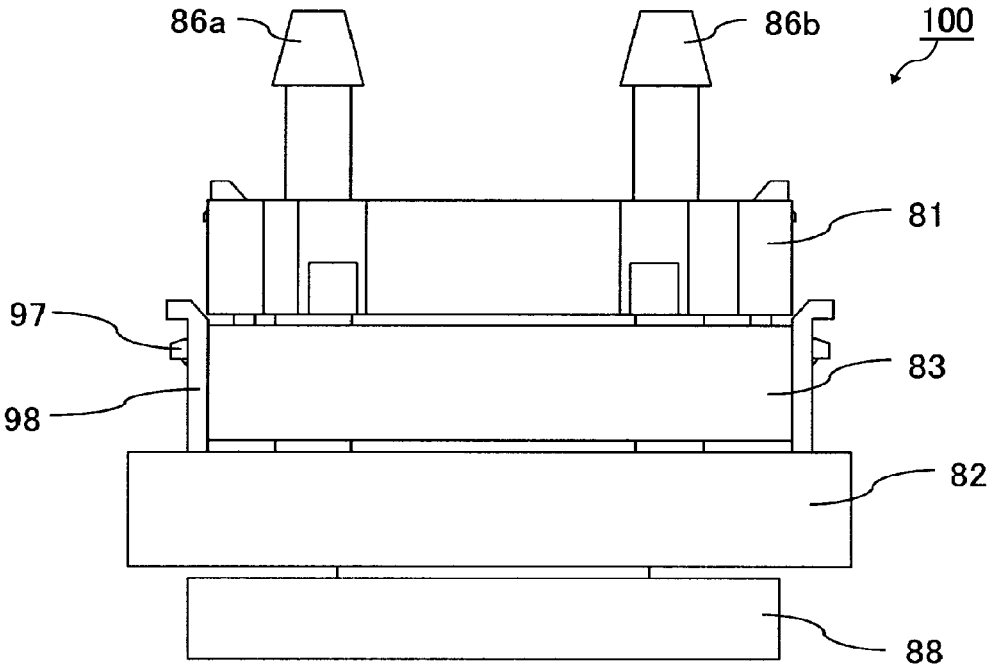
FIG. 9A is a front view of the liquid discharge head and FIG. 9B is a side view of the liquid discharge head in the Embodiment 4.
Figure 9B:
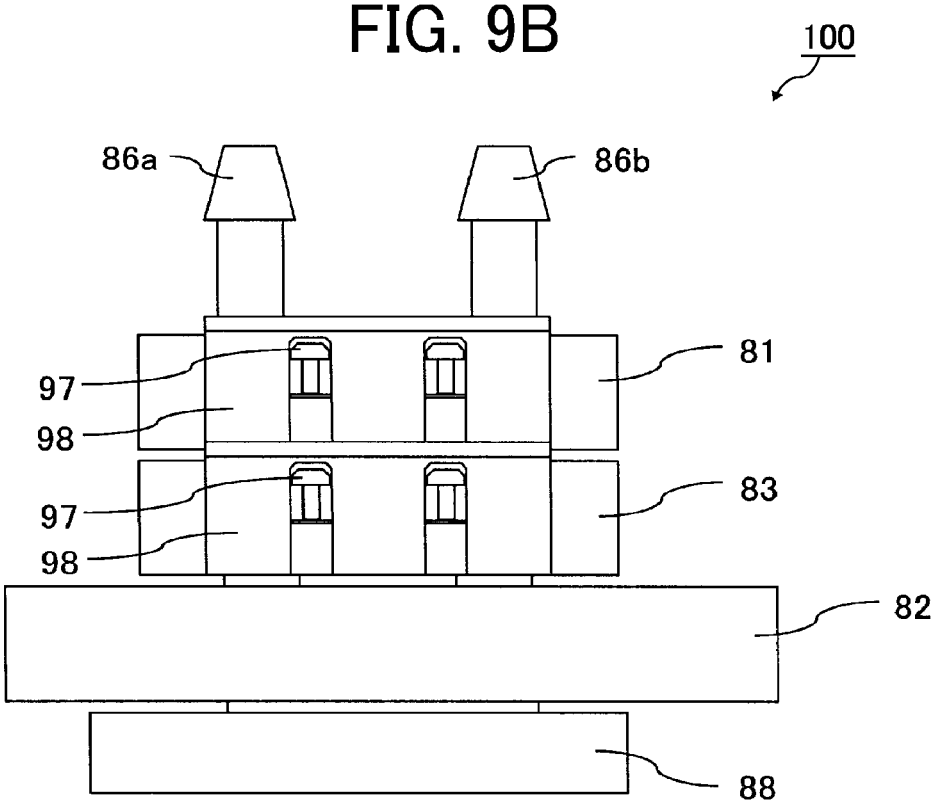

FIGS. 9A and 9B illustrate an example in which each member of the ink port 81, the frame 82, the filter 83, and the channel forming member 88 of the head 100 according to the present embodiment is connected.

FIG. 9A is a front view of the head 100 according to the Embodiment 4.

FIG. 9B is a side view of the head 100 according to the Embodiment 4.

FIGS. 9A and 9B illustrate an example in which the channel forming member 88 is connected to the frame 82.

In the Embodiment 4, each of the ink port 81 and the filter 83 includes the first latching member (protruding part 97, for example). Each of the frame 82 and the filter 83 includes the second latching member (claw 98, for example) that can be latched on the first latching member. Thus, the 98 of the filter 83 can be hooked on the protruding part 97 of the ink port 81 as illustrated in FIG. 8. The claw 98 of the frame 82 can be hooked on the protruding part 97 of the filter 83.

Thus, the members such as the ink port 81, the frame 82, and the filter 83 can be more firmly fixed to each other. The Embodiment 4 does not have to include the protruding part 97 and the claw 98 as essential elements. However, usage of the protruding part 97 and the claw 98 can more firmly connect the members of the ink port 81, the frame 82, and the filter 83 to reduce a positional displacement of the members.

In the Embodiment 4, the protruding part 97 of the ink port 81 and the protruding part 97 of the filter 83 have the same shape or substantially the same shape. The claw 98 of the filter 83 and the claw 98 of the frame 82 have the same shape or substantially the same shape. Thus, the filter 83 is removed and the claw 98 of the frame 82 is latched on the protruding part 97 of the ink port 81 so that the ink port 81 and the frame 82 can be fixed to each other.

The Embodiment 4 illustrates an example in which the ink port 81 includes the protruding part 97 and the frame 82 includes the claw 98. However, the embodiment 4 is not limited to a configuration as described above. For example, the ink port 81 may include the claw 98 and the frame 82 may include the protruding part 97. That is, the ink port 81 may include the claw 98, and the frame 82 may include the protruding part 97.

In the Embodiment 4, the filter 83 is used as the intermediate member as described above. However, the same effect as described above can be obtained even by using the damper 84 as the intermediate member instead of the filter 83, or even by using another intermediate member in addition to the filter 83. Further, the intermediate member having the same configuration as the configuration of the filter 83 can be used to form various combinations of the head 100.

[Basic Configuration of Head, Liquid Discharge device, and Liquid Discharge Apparatus]

A basic configuration of the head 100 according to the present embodiment is described below.

FIG. 10 is a cross-sectional view of the head 100 along a direction (pressure-chamber longitudinal direction) orthogonal to a nozzle array direction of the head 100 according to an embodiment of the present disclosure.

Figure 11:
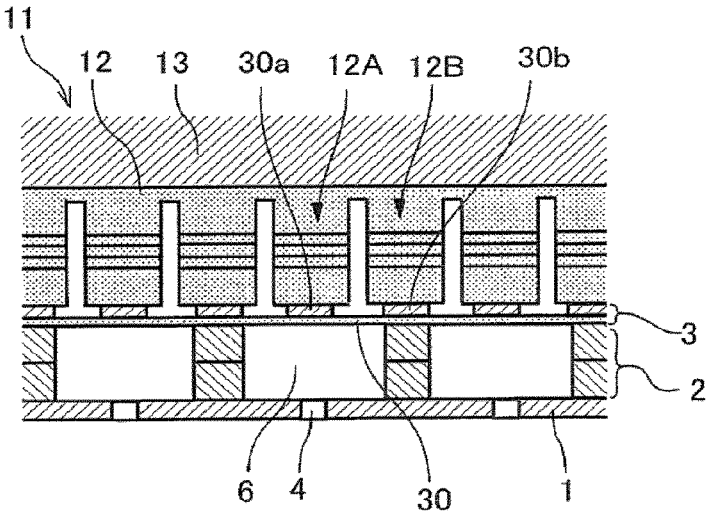
FIG. 11 is another schematic cross-sectional view of the liquid discharge head according to still another embodiment of the present disclosure.

FIG. 11 is a schematic cross-sectional view of a portion of the head 100 of FIG. 10 along the nozzle array direction.

In this example, the same members as the members described in the above embodiment are denoted by different reference numerals.

The head 100 according to the present embodiment includes a nozzle plate 1, a channel plate 2 as an individual-channel member, and a diaphragm 3 as a wall that are laminated one on another and bonded to each other. The head 100 further includes a piezoelectric actuator 11 to displace vibration regions 30 (vibration plate) of the diaphragm 3 and a common channel member 20 also serving as a frame of the head 100.

The nozzle plate 1 includes a plurality of nozzles 4 to discharge a liquid.

The channel plate 2 forms a plurality of pressure chambers 6 communicating with the plurality of nozzles 4, a plurality of individual supply channels 7 that are individual channels communicating with the respective pressure chambers 6, and one or more intermediate supply channel 8 that is a liquid introduction portion communicating with one or more individual supply channel 7. Here, one individual supply channel 7 is illustrated in the present embodiment.

The diaphragm 3 includes a plurality of deformable vibration region 30 (vibration plate) that forms walls of pressure chambers 6 of the channel plate 2. Here, the diaphragm 3 has a two-layer structure and includes a first layer 3A forming a thin portion and a second layer 3B forming a thick portion in this order from a side facing the channel plate 2. Note that the structure of the diaphragm substrate is not limited to such a two-layer structure and may be any suitable layer structure.

The displaceable vibration region 30 is formed in a portion corresponding to the pressure chamber 6 in the first layer 3A that is a thin portion. In the vibration region 30, a convex portion 30*a* and 30*b* (see FIG. 11) are formed as a thick portion joined to the piezoelectric actuator 11 in the second layer 3B.

The piezoelectric actuator 11 includes electromechanical transducer element as a driving device (actuator device or pressure generator) to deform the vibration regions 30 of the diaphragm 3. The piezoelectric actuator 11 is disposed at a first side of the diaphragm 3 opposite a second side of the diaphragm 3 facing the pressure chambers 6.

The piezoelectric actuator 11 includes a piezoelectric member bonded on a base 13. The piezoelectric member is groove-processed by half cut dicing so that each piezoelectric member includes a desired number of pillar-shaped piezoelectric elements 12 that are arranged in certain intervals to have a comb shape in the nozzle array direction. The piezoelectric element 12 is joined to the convex portions 30*a* and 30*b*, which are thick portions formed on the vibration region 30 of the diaphragm 3. The piezoelectric element 12 includes a first piezoelectric element 12A and a second piezoelectric element 12B. The first piezoelectric element 12A is driven to deform the vibration region 30 of the diaphragm 3. The second piezo element 12B serves as a support and is not driven to deform the vibration region 30 of the diaphragm.

The piezoelectric element 12 includes piezoelectric layers and internal electrodes alternately laminated on each other. Each internal electrode is drawn out to an end face of the piezoelectric element 12 and connected to an external electrode (end surface electrode), and a flexible wiring member 15 is connected to the external electrode.

The common channel member 20 forms a common supply channel 10 communicated with the plurality of pressure chambers 6. The common supply channel 10 communicates with the intermediate supply channel 8 serving as a liquid inlets through the opening 9 formed in the diaphragm 3 and further communicates with the individual supply channel 7 through the intermediate supply channel 8.

In the head 100, for example, the voltage to be applied to the piezoelectric element 12 is lowered from a reference potential (intermediate potential) so that the piezoelectric element 12 contracts to pull the vibration region 30 of the diaphragm 3 to increase a volume of the pressure chamber 6. As a result, liquid flows into the pressure chamber 6.

When the voltage applied to the piezoelectric element 12 is raised, the piezoelectric element 12 expands in a direction of lamination of the piezoelectric element 12. The vibration region 30 of the diaphragm 3 deforms in a direction toward the nozzle 4 and contracts the volume of the pressure chambers 6. As a result, the liquid in the pressure chambers 6 is squeezed out of the nozzle 4 so that the liquid is discharged from the nozzle 4.

Figure 12:
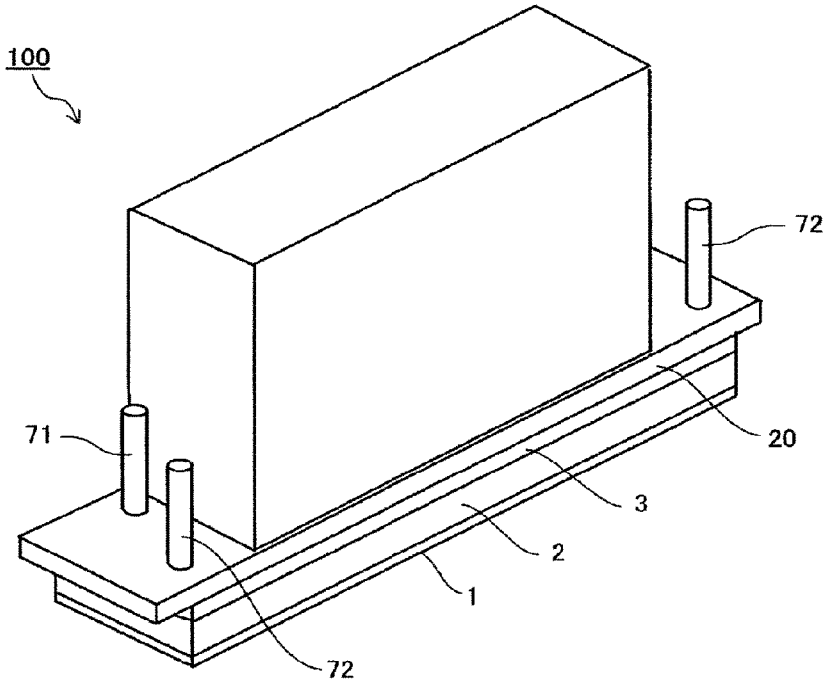
FIG. 12 is a schematic perspective view of the liquid discharge head according to still another embodiment of the present disclosure.

FIG. 12 is a perspective view of the head 100 according to still another embodiment.

Figure 13:
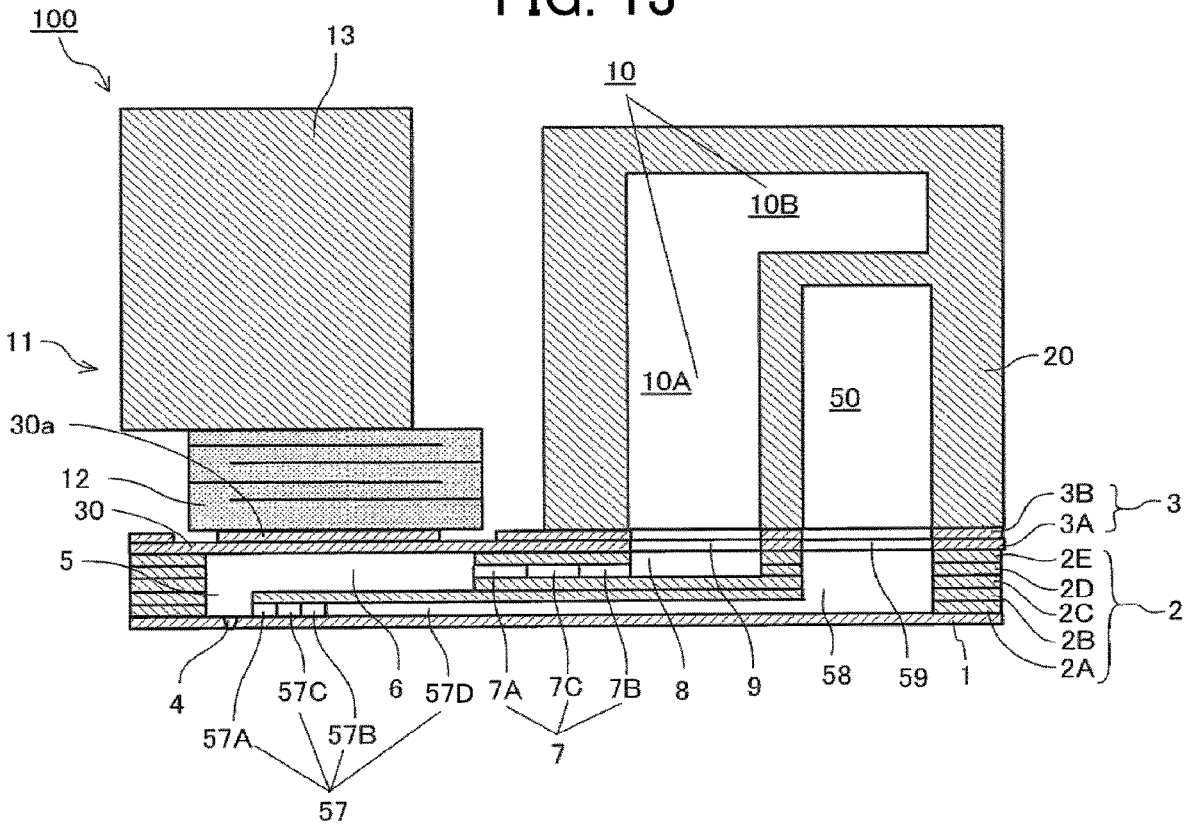
FIG. 13 is a schematic cross-sectional view of the liquid discharge head according to still another embodiment of the present disclosure.

FIG. 13 is a cross-sectional view of the head 100 according to another embodiment, along a direction (pressure-chamber longitudinal direction) orthogonal to the nozzle array direction of the head 100.

The head 100 according to the present embodiment is a circulation-type liquid discharge head. The head 100 includes the nozzle plate 1, the channel plate 2, and the diaphragm 3 as a wall laminated and bonded with each other. The head 100 further includes a piezoelectric actuator 11 to displace vibration regions 30 (vibration plate) of the diaphragm 3 and a common channel member 20 also serving as a frame of the head 100.

The channel plate 2 includes pressure chambers 6, individual supply channels 7, and an intermediate supply channel 8, for example. The pressure chambers 6 respectively communicate with the nozzles 4 via the nozzle communication channels 5.

The individual supply channels 7 also serve as fluid restrictors respectively communicating with the pressure chambers 6. The intermediate supply channel 8 serves as one or more liquid introduction portions communicating with two or more individual supply channels 7.

Similarly to the above-described embodiment, the individual supply channel 7 includes two channel portions, i.e., a first channel portion 7A and a second channel portion 7B having a higher fluid resistance than the pressure chamber 6, and a third channel portion 7C disposed between the first channel portion 7A and the second channel portion 7B and having a lower fluid resistance than each of the first channel portion 7A and the second channel portion 7B.

The channel plate 2 has a configuration in which a plurality of plate members 2A and 2E (see FIG. 13) are stacked one on another. However, the configuration of the channel plate 2 is not limited to a configuration as described above.

As illustrated in FIG. 13, the channel plate 2 forms a plurality of individual collection channels 57 and an intermediate collection channel 58. The plurality of individual collection channels 57 are formed along the surface direction of the channel plate 2 that respectively communicate with the plurality of pressure chambers 6 via the nozzle communication channels 5. The intermediate collection channel 58 serves as one or a plurality of liquid introduction portions that communicate with two or more individual collection channels 57.

The individual collection channel 57 includes two channel portions, i.e., a first channel portion 57A and a second channel portion 57B having a higher fluid resistance than the pressure chamber 6, and a third channel portion 57C disposed between the first channel portion 57A and the second channel portion 57B and having a lower fluid resistance than each of the first channel portion 57A and the second channel portion 57B. In the individual collection channel 57, a channel portion 57D downstream from the second channel portion 57B in the direction of circulation of the liquid has the same channel width as the third channel portion 57C. The direction of circulation of the liquid is also referred to as a "liquid supply direction" or "liquid circulation direction".

The common channel member 20 forms a common supply channel 10 and a common collection channel 50. In the present embodiment, the common supply channel 10 includes a channel portion 10A arranged side-by-side with the common collection channel 50 in the nozzle array direction and a channel portion 10B that is not arranged side-by-side with the common collection channel 50.

The common supply channel 10 communicates with the intermediate supply channel 8 serving as a liquid inlets through the opening 9 formed in the diaphragm 3 and further communicates with the individual supply channel 7 through the intermediate supply channel 8. The common collection channel 50 communicates with the intermediate collection channel 58 serving as the liquid outlet through an opening 59 formed in the diaphragm 3 and further communicates with the individual collection channel 57 through the intermediate collection channel 58.

The common supply channel 10 communicates with supply ports 71. The common collection channel 50 communicates with collection ports 72. The supply port 71 may be connected to the ink supply port 86*a*, and the collection port 72 may be connected to the ink supply port 86*b*. Further, the positions, the number, and the like of the supply port 71 and the collection port 72 may be appropriately changed to form the ink supply ports 86*a* and 86*b*.

A layer structure of the diaphragm 3 and a structure of the piezoelectric actuator 11 are the same as the layer structure of the diaphragm 3 and the structure of the piezoelectric actuator 11 in the above-described embodiment.

In this head 100 also, as similarly with the above embodiments, when the voltage applied to the piezoelectric element 12 is raised, the piezoelectric element 12 expands in a direction of lamination of the piezoelectric element 12. The vibration region 30 of the diaphragm 3 deforms in a direction toward the nozzle 4 and contracts the volume of the pressure chambers 6. As a result, the liquid in the pressure chambers 6 is squeezed out of the nozzle 4 so that the liquid is discharged from the nozzle 4.

The liquid not discharged from the nozzle 4 passes by the nozzle 4, is collected from the individual collection channel 57 to the common collection channel 50, and is supplied again from the common collection channel 50 to the common supply channel 10 through an external circulation passage. Even when the liquid is not discharged from the nozzle 4, the liquid flows and circulates from the common supply channel 10 to the common collection channel 50 through the pressure chamber 6 and is again supplied to the common supply channel 10 through the external circulation passage.

Accordingly, also in the present embodiment, the pressure fluctuation accompanying liquid discharge can be attenuated with a simple configuration, thus restraining propagation of the pressure fluctuation to the common supply channel 10 and the common collection channel 50.

Next, a printer 500 as an example of a liquid discharge apparatus according to the present embodiment is described with reference to FIGS. 14 and 15.

The liquid discharge device according to an embodiment of the present disclosure includes the head according to the above-described embodiments of the present disclosure. Further, the liquid discharge device according to the present embodiment includes the head 100 and at least one of: a head tank that stores liquid to be supplied to the head 100, a carriage on which the head 100 is mounted, a supply unit that supplies liquid to the head 100; a maintenance unit that maintains and recover a discharge function of the head 100; and a main scan moving unit to move the head 100 in the main scanning direction to form a single unit.

The liquid discharge apparatus according to the present embodiment includes the head (liquid discharge head) or the liquid discharge device according to the present embodiment.

The printer 500 (liquid discharge apparatus) according to a first embodiment of the present disclosure is described in detail below with reference to FIGS. 14 and 15.

Figure 14:
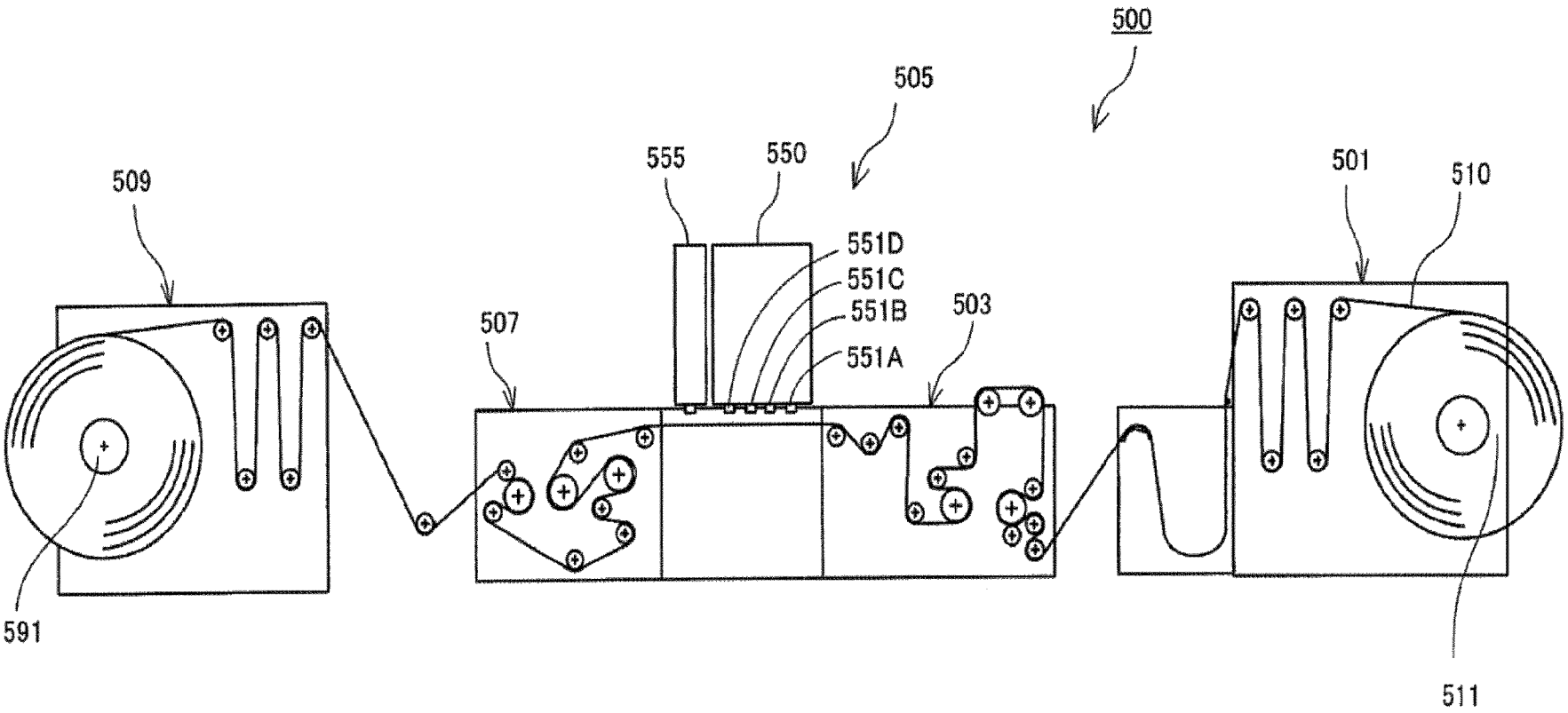
FIG. 14 is a schematic side view of a liquid discharge apparatus according to an embodiment of the present disclosure.

FIG. 14 is a side view of the printer 500 as a liquid discharge apparatus according to an embodiment of the present disclosure.

Figure 15:
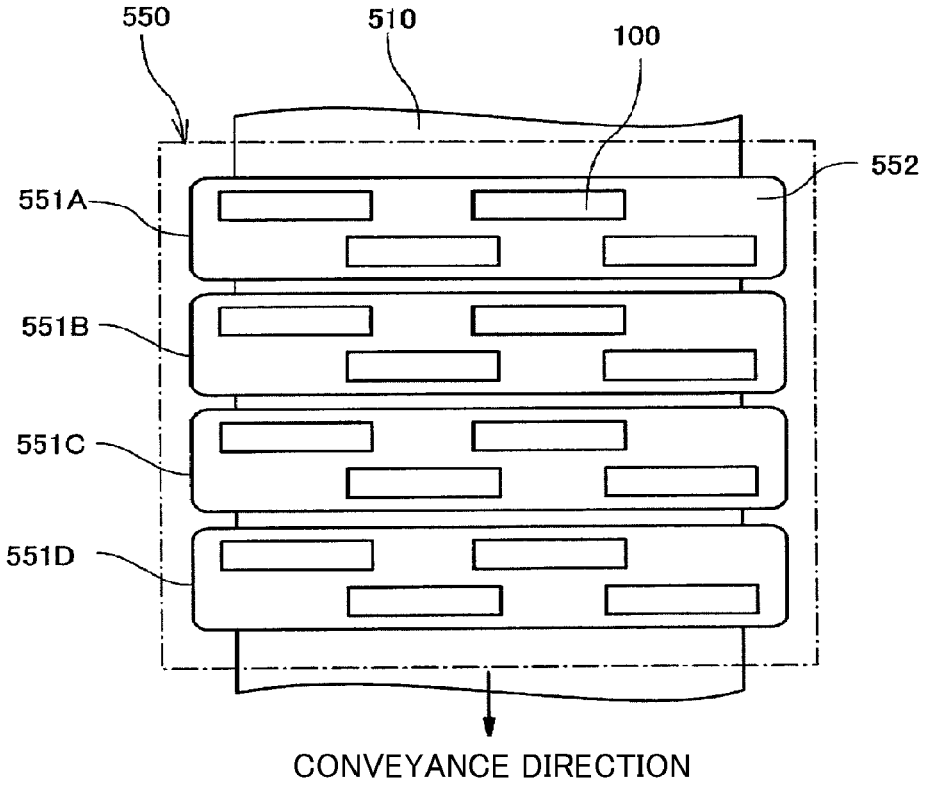
FIG. 15 is a schematic plan view of an example of a head unit of the liquid discharge apparatus of FIG. 12.

FIG. 15 is a plan view of a head unit of the printer 500 as a liquid discharge device according to the embodiment of the present disclosure.

A printer 500 serving as the liquid discharge apparatus includes a feeder 501, a guide conveyor 503, a printing device 505, a dryer 507, and an ejector 509. The feeder 501 feeds a continuous medium 510 such as a rolled sheet. The guide conveyor 503 guides and conveys the continuous medium 510, fed from the feeder 501, to the printing device 505. The printing device 505 discharges a liquid onto the continuous medium 510 to form an image on the continuous medium 510. The dryer 507 dries the continuous medium 510. The ejector 509 ejects the continuous medium 510.

The continuous medium 510 is fed from a winding roller 511 of the feeder 501, guided and conveyed with rollers of the feeder 501, the guide conveyor 503, the dryer 507, and wound around a take-up roller 591 of the ejector 509.

In the printing device 505, the continuous medium 510 is conveyed on a conveyance guide so as to face a head unit 550 and a head unit 555. An image is formed with the liquid discharged from the head unit 550, and post-processing is performed with a treatment liquid discharged from the head unit 555.

The head unit 550 includes, for example, four-color full-line head arrays 551A, 551B, 551C, and 551D from an upstream side in a conveyance direction (see FIG. 15) of the continuous medium 510 from right to left in FIG. 14. Hereinafter, the four-color full-line head arrays 551A, 551B, 551C, and 551D are collectively referred to as "head arrays 551" unless colors are distinguished.

Each of the head arrays 551 is a liquid discharge device to discharge liquid of black (K), cyan (C), magenta (M), and yellow (Y) onto the continuous medium 510 conveyed in the conveyance direction of the continuous medium 510. Note that number and types of color are not limited to the above-described four colors of K, C, M, and Y and may be any other suitable number and types.

In each head arrays 551, for example, as illustrated in FIG. 15, heads 100 are staggered on a base 552 to form the head array 551. Note that the configuration of the head array 551 is not limited to such a configuration. The head 100 has a configuration of one of the head 100 illustrated in FIGS. 1 to 13.

Figure 16:
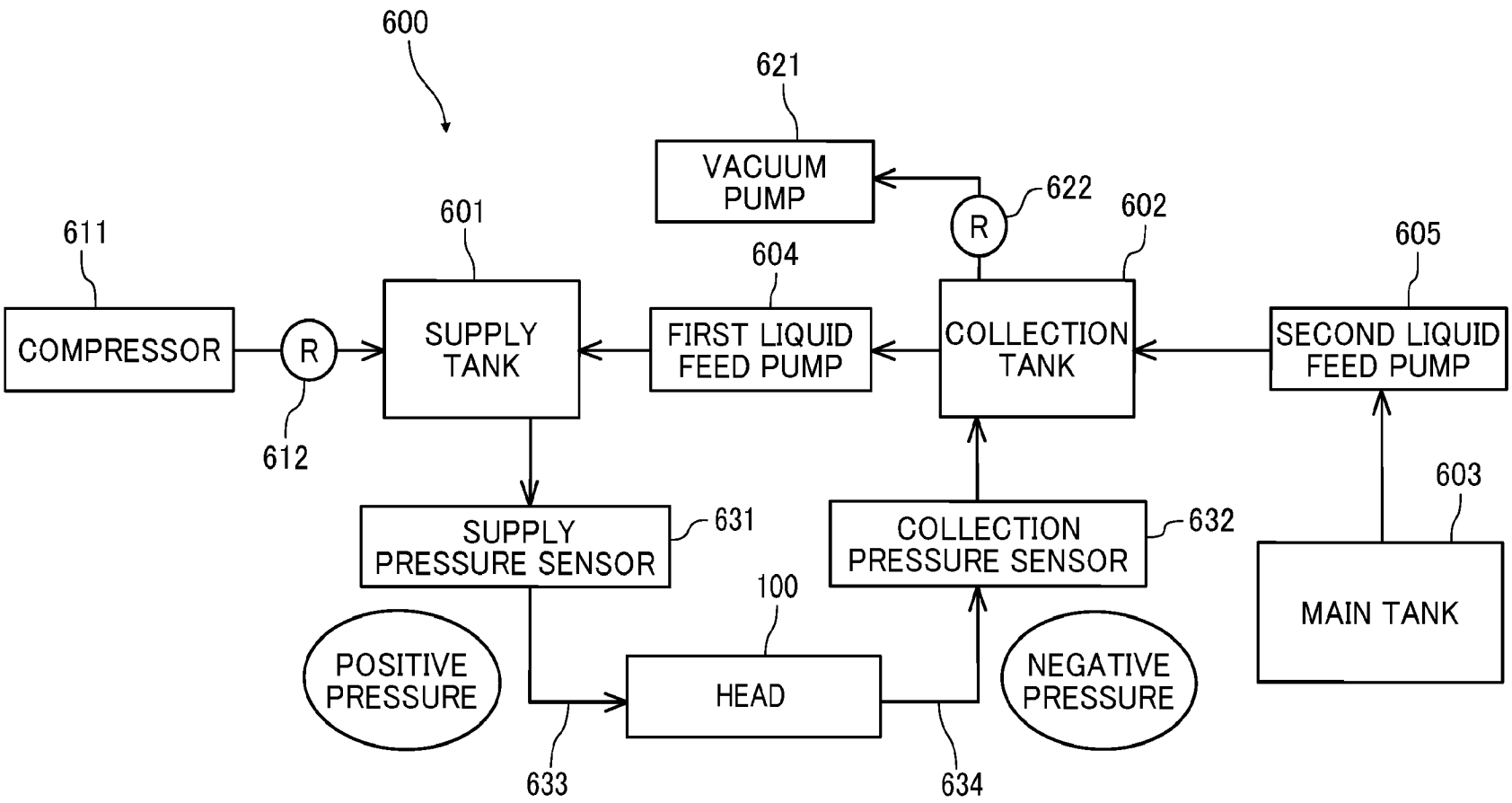
FIG. 16 is a circuit diagram of a liquid circulating apparatus according to an embodiment of the present disclosure.

Next, following describes an example of a liquid circulation device 600 employed in the printer 500 as the liquid discharge apparatus according to the present embodiment with reference to FIG. 16.

FIG. 16 is a circuit diagram illustrating a structure of the liquid circulation device 600. Although only one head 100 is illustrated in FIG. 16, in the structure including a plurality of heads 100 as illustrated in FIGS. 14 and 15, supply channels and collection channels are respectively coupled to supply-sides and collection-sides of the plurality of heads 100 via manifolds or the like.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply pressure sensor 631, and a collection pressure sensor 632.

The compressor 611 and the vacuum pump 621 together generate a pressure difference between the pressure in the supply tank 601 and the pressure in the collection tank 602.

The supply pressure sensor 631 is between the supply tank 601 and the head 100 and connected to the supply channels connected to the supply port 71 of the head 100. The collection pressure sensor 632 is between the head 100 and the collection tank 602 and connected to the collection channel connected to the collection port 72 of the head 100.

One end of the collection tank 602 is coupled to the supply tank 601 via the first liquid feed pump 604, and another end of the collection tank 602 is coupled to the main tank 603 via the second liquid feed pump 605.

Accordingly, the liquid flows from the supply tank 601 into the head 100 through the supply port 71. Then, the liquid is collected from the collection port 72 to the collection tank 602, and is sent from the collection tank 602 to the supply tank 601 by the first liquid feed pump 604, thereby forming a circulation path through which the liquid circulates.

Here, a compressor 611 is connected to the supply tank 601 and is controlled so that a predetermined positive pressure is detected by the supply pressure sensor 631. Conversely, a vacuum pump 621 is connected to the collection tank 602 and is controlled so that a predetermined negative pressure is detected by the collection pressure sensor 632.

Such a configuration allows the menisci of ink in the head 100 to be maintained at a constant negative pressure while circulating liquid through the inside of the head 100.

When droplets are discharged from the nozzles 4 of the head 100, the amount of liquid in each of the supply tank 601 and the collection tank 602 decreases. Accordingly, the collection tank 602 is replenished with the liquid fed from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied from the main tank 603 to the collection tank 602 when the liquid level in the collection tank 602 becomes lower than a predetermined height.

Next, another example of a printer 500 serving as a liquid discharge apparatus according to an embodiment of the present disclosure is described with reference to FIGS. 17 and 18.

Figure 17:
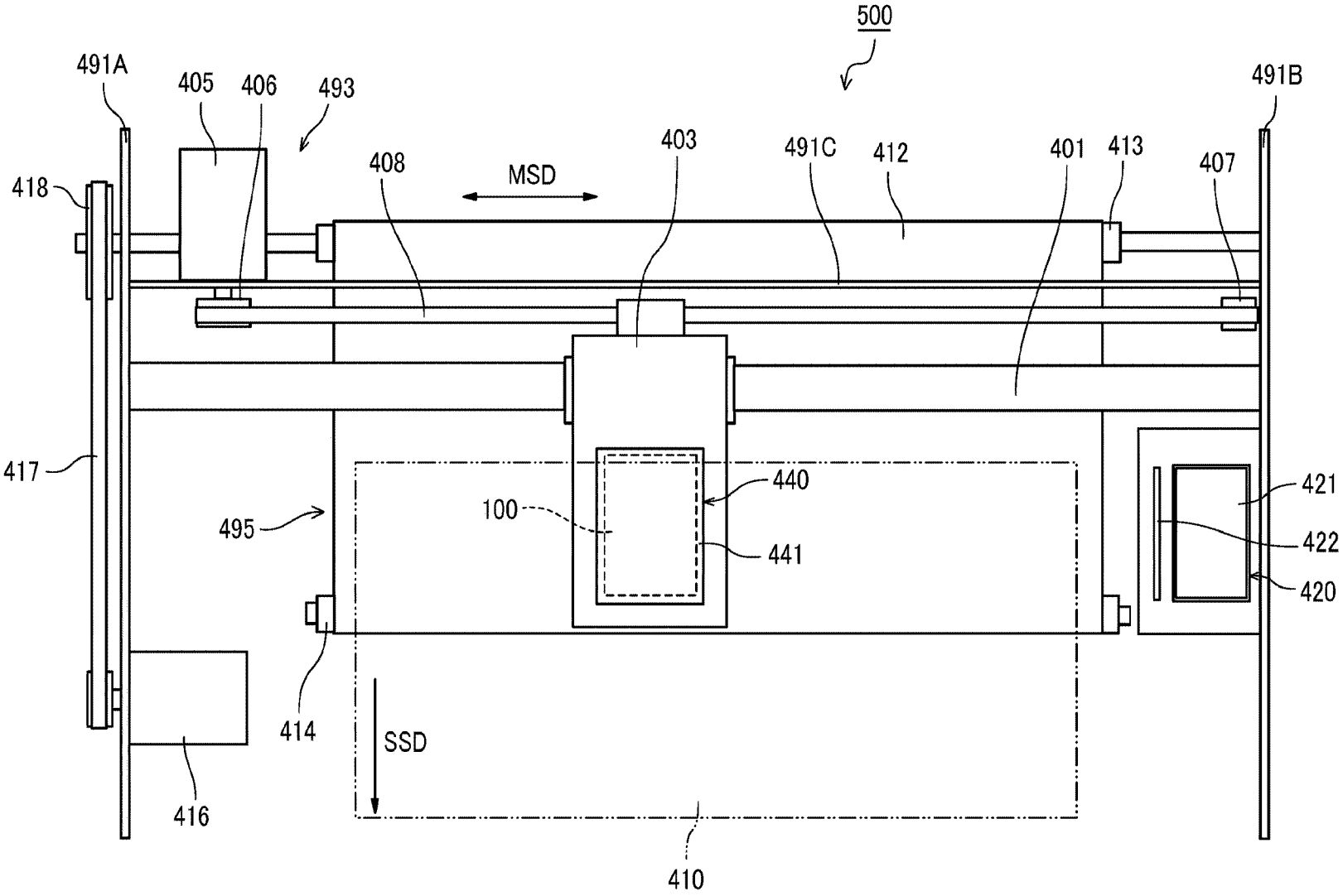
FIG. 17 is a schematic plan view of another example of the liquid discharge apparatus according to another embodiment of the present disclosure.

FIG. 17 is a plan view of a portion of the printer 500.

Figure 18:
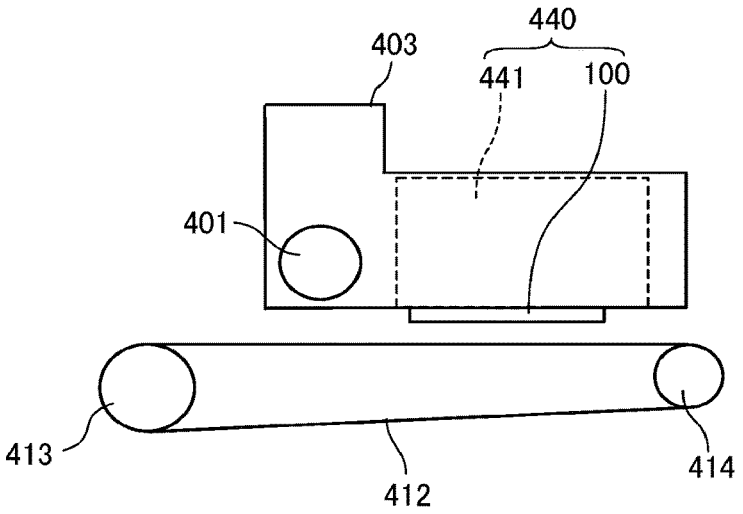
FIG. 18 is a schematic side view of the liquid discharge apparatus of FIG. 17.

FIG. 18 is a side view of a portion of the printer 500 of FIG. 17.

The printer 500 is a serial type apparatus, and a carriage 403 is reciprocally moved in a main scanning direction indicated by arrow "MSD" by a main scan moving unit 493. The main scan moving unit 493 includes a guide 401, a main scan motor 405, a timing belt 408, and the like. The guide 401 is bridged between a left-side plate 491A and a right-side plate 491B to moveably hold the carriage 403. The main scan motor 405 reciprocally moves the carriage 403 in the main scanning direction MSD via the timing belt 408 bridged between a drive pulley 406 and a driven pulley 407.

The carriage 403 mounts a liquid discharge device 440. The head 100 and a head tank 441 forms the liquid discharge device 440 as a single unit. The head 100 has a configuration of one of the head 100 illustrated in FIGS. 1 to 13. The head 100 of the liquid discharge device 440 discharges color liquids of, for example, yellow (Y), cyan (C), magenta (M), and black (K).

The head 100 includes a nozzle array including the plurality of nozzles 4 arrayed in row in a sub scanning direction indicated by arrow "SSD" perpendicular to the main scanning direction MSD in FIG. 17. The head 100 is mounted to the carriage 403 so that ink droplets are discharged downward from the nozzles 4.

The head 100 is connected to a liquid circulation device so that a liquid of a required color is circulated and supplied.

The printer 500 includes a conveyor 495 to convey a sheet 410. The conveyor 495 includes a conveyance belt 412 as a conveyor and a sub scan motor 416 to drive the conveyance belt 412.

The conveyance belt 412 attracts the sheet 410 and conveys the sheet 410 at a position facing the head 100. The conveyance belt 412 is an endless belt stretched between a conveyance roller 413 and a tension roller 414. Attraction of the sheet 410 to the conveyance belt 412 may be applied by electrostatic adsorption, air suction, or the like.

The conveyance belt 412 rotates in the sub scanning direction SSD as the conveyance roller 413 is rotationally driven by the sub scan motor 416 via the timing belt 417 and the timing pulley 418.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap a nozzle surface of the head 100, a wiper 422 to wipe the nozzle surface, and the like. The nozzle surface is an outer surface of the nozzle plate 1 (see FIG. 11) on which the nozzles 4 are formed.

The main scan moving unit 493, the maintenance unit 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Next, the liquid discharge device 440 according to a still another embodiment of the present disclosure is described with reference to FIG. 19.

Figure 19:
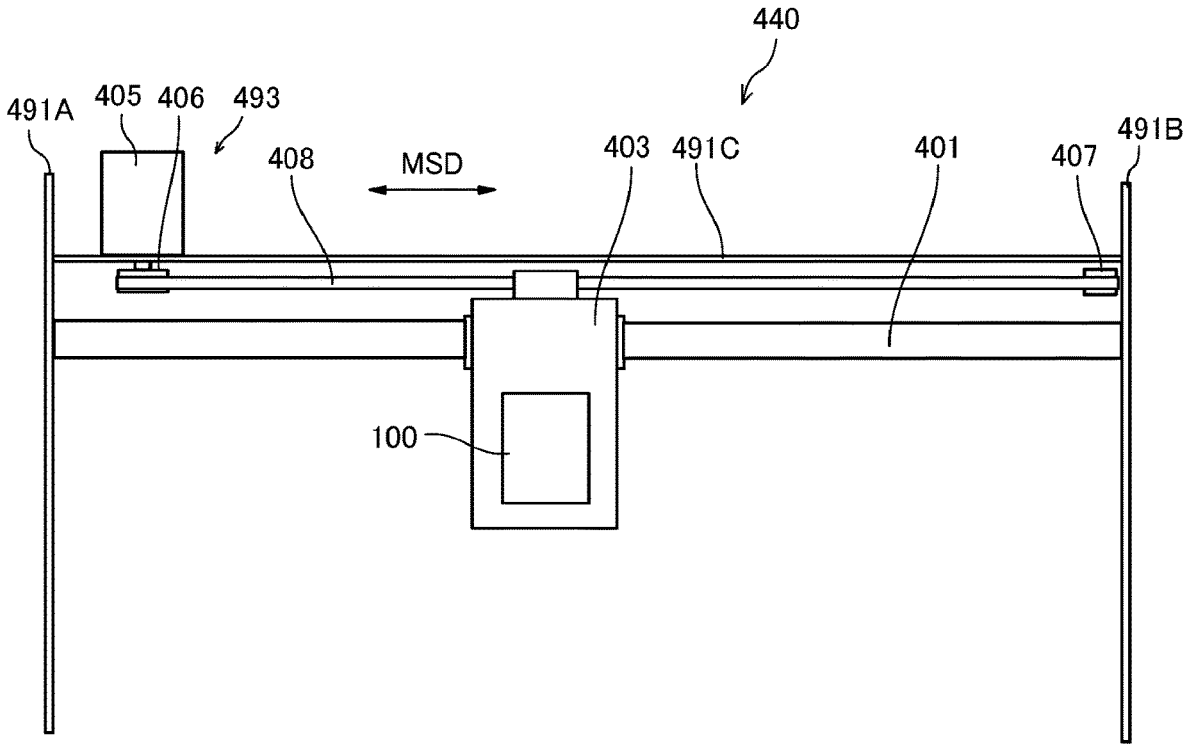
FIG. 19 is a schematic plan view of a liquid discharge device according to still another embodiment of the present disclosure.

FIG. 19 is a plan view of a portion of the liquid discharge device 440 according to the still another embodiment of the present disclosure.

The liquid discharge device 440 includes a housing, the main scan moving unit 493, the carriage 403, and the head 100 among components of the printer 500 in FIG. 17. The left-side plate 491A, the right-side plate 491B, and the rear-side plate 491C constitute the housing.

Note that, in the liquid discharge device 440, the maintenance unit 420 described above may be mounted on, for example, the right-side plate 491B.

Next, still another example of the liquid discharge device 440 according to the present embodiment is described with reference to FIG. 20.

Figure 20:
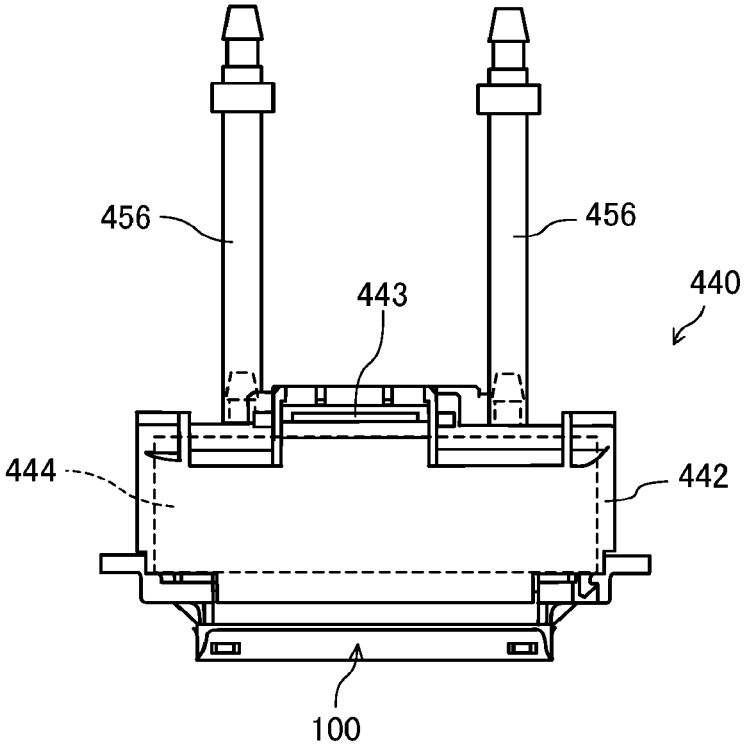
FIG. 20 is a schematic side view of the liquid discharge device according to still another embodiment of the present disclosure.

FIG. 20 is a schematic front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. In some embodiments, the liquid discharge device 440 may include the head tank 441 instead of the channel part 444. A connector 443 electrically connected with the head 100 is provided on an upper part of the channel part 444.

According to the present embodiment, it is possible to provide a liquid discharge head that is easily detachably attached an unnecessary member or a necessary member. The liquid discharge head can easily maintain a channel even when the member is detached.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or unit(s) combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes a tube connected to the head mounting the head tank or the channel part so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to drive the head to discharge liquid.

The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used in the present embodiments may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a liquid port;

a frame including a liquid channel in which a liquid supplied from the liquid port flows; and an intermediate structure between the liquid port and the frame, wherein the liquid port comprises a first connector connectable to the frame;

the frame comprises a second connector connectable to the first connector of the liquid port; and the intermediate structure comprises a third connector connectable to the second connector of the frame and a fourth connector connectable to the first connector of the liquid port, wherein the third connector of the intermediate structure has a shape identical to a shape of the first connector of the liquid port, and wherein the fourth connector of the intermediate structure has a shape identical to a shape of the second connector of the frame.

2. The liquid discharge head according to claim 1, wherein the third connector of the intermediate structure is an opening, and the fourth connector of the intermediate structure has a tubular shape connectable to the opening.

3. The liquid discharge head according to claim 1, wherein the intermediate structure is at least one of a filter and a damper.

4. The liquid discharge head according to claim 1, wherein the intermediate structure includes multiple intermediate structures, and the multiple intermediate structures are connected to each other.

5. The liquid discharge head according to claim 2, wherein the intermediate structure includes a filter and a damper.

6. The liquid discharge head according to claim 1, wherein each of the liquid port and the intermediate structure includes a first latch, and each of the frame and the intermediate structure includes a second latch configured to latch with the first latch.

7. The liquid discharge head according to claim 6, wherein the first latch includes a protruding part, and the second latch includes a claw configured to latch the protruding part.

8. The liquid discharge head according to claim 1, further comprising:

a nozzle configured to discharge the liquid;

a supply channel upstream from the nozzle in a liquid supply direction; and a collection channel downstream from the nozzle in the liquid supply direction, wherein the liquid is circulated from the supply channel to the collection channel through the nozzle in the liquid supply direction, and the first connector includes a first supply connector and a first collection connector;

the second connector includes a second supply connector and a second collection connector;

the third connector includes a third supply connector and a third collection connector; and the fourth connector includes a fourth supply connector and a fourth collection connector, and the supply channel includes the first supply connector, the second supply connector, the third supply connector, and the fourth supply connector, and the collection channel includes the first collection connector, the second collection connector, the third collection connector, and the fourth collection connector.

9. A liquid discharge device comprising the liquid discharge head according to claim 1.

10. The liquid discharge device according to claim 9, further comprising at least one of:

a head tank configured to store the liquid to be supplied to the liquid discharge head;

a carriage mounting the liquid discharge head;

a supplier configured to supply the liquid to the liquid discharge head;

a maintainer configured to maintain the liquid discharge head; and a main scan mover configured to move the carriage in a main scanning direction, wherein the liquid discharge head and said at least one of the head tank, the carriage, the supplier, the maintainer, and the main scan mover forms a single unit.

11. A liquid discharge apparatus comprising the liquid discharge device according to claim 9.

* * * * *